US008698864B2

(12) United States Patent
Nagumo

(10) Patent No.: US 8,698,864 B2
(45) Date of Patent: Apr. 15, 2014

(54) DRIVER APPARATUS, PRINT HEAD AND IMAGE FORMING APPARATUS

(75) Inventor: Akira Nagumo, Takasaki (JP)

(73) Assignee: Oki Data Corporation, Tokyo (JP)

( * ) Notice: Subject to any disclaimer, the term of this patent is extended or adjusted under 35 U.S.C. 154(b) by 42 days.

(21) Appl. No.: 13/433,804

(22) Filed: Mar. 29, 2012

(65) Prior Publication Data

US 2012/0251181 A1 Oct. 4, 2012

(30) Foreign Application Priority Data

Mar. 30, 2011 (JP) ..... 2011-075915

(51) Int. Cl.
*B41J 2/435* (2006.01)
*B41J 2/47* (2006.01)

(52) U.S. Cl.
USPC ..... 347/237; 347/247

(58) Field of Classification Search
USPC ..... 347/237, 238, 247
See application file for complete search history.

(56) References Cited

U.S. PATENT DOCUMENTS 7,286,259 B2 * 10/2007 Ohno et al. ..... 358/1.8
2010/0045763 A1 * 2/2010 Tsuchiya ..... 347/130

FOREIGN PATENT DOCUMENTS

JP 2004-195796 A 7/2004

* cited by examiner

*Primary Examiner* — Hai C Pham
(74) *Attorney, Agent, or Firm* — Panitch Schwarze Belisario & Nadel LLP

(57) ABSTRACT

A driver apparatus drives aligned light emitting thyristors. Each thyristor includes an anode, a cathode, and a gate. The driver apparatus includes a common terminal, a first resistor, a second resistor, and a switch. Each thyristor is disposed at a first position where the anode is connected to the first potential and the cathode is connected to the common terminal, or a second position where the anode is connected to the common terminal and the cathode is connected to the second potential. The first resistor is connected between the first potential and the common terminal. The second resistor is connected between the common terminal and the second potential. The switch is connected at a third position where the switch is connected between the between the first potential and the common terminal, or a fourth position where the switch is connected between the common terminal and the second potential.

10 Claims, 17 Drawing Sheets

FIRST EMBODIMENT

COMPARATIVE EXAMPLE $$V_1 = \frac{R65}{R64+R65} \times VDD$$

R65 : RESISTANCE OF RESISTOR 65

R64 : RESISTANCE OF RESISTOR 64

$$V_3 = \frac{R65}{R64+R65} \times VDD$$

R65 : RESISTANCE OF RESISTOR 65

R64 : RESISTANCE OF RESISTOR 64

DRIVER APPARATUS, PRINT HEAD AND IMAGE FORMING APPARATUS

BACKGROUND OF THE INVENTION

1. Field of the Invention

The present invention relates to a driver circuit that drives a light emitting thyristor array, a driver apparatus that employs the driver circuit, a print head that employs the driver apparatus, and an image forming apparatus that employs the print head.

2. Description of the Related Art

Some electrophotographic image forming apparatus include an exposing section incorporating a plurality of light emitting thyristors as light emitting elements. A single driver circuit drives one or more light emitting thyristors. Each light emitting thyristor is energized by a trigger signal applied to its gate electrode, so that current flows from anode to cathode to emit light.

Japanese Patent Publication No. 2004-195796 discloses a self-scanned print head that incorporates light emitting thyristors. The self-scanned print head includes a scanning circuit in which a plurality of thyristors form a scanning circuit in the form of a shift register, and a plurality of light emitting thyristors emit light. The scanning circuit section specifies the order in which the light emitting thyristors are energized to emit light.

Conventional self-scanned print heads suffer from the following drawbacks. The light emitting thyristors have commonly connected anodes and commonly connected cathodes. Thus, the parasitic capacitances between the anode and cathode of the light emitting thyristors are connected in parallel with one another to form a large capacitance. When the light emitting thyristors are driven in sequence, the large capacitance causes a long delay time for each light emitting thyristor to emit light, shortening the time period during which the light emitting thyristor emits light. This is detrimental to the high speed operation of the print head, resulting in longer printing time.

There exists a need for the configuration that is effective in shortening the rise time that would otherwise tend to be long due to the parasitic capacitance of light emitting thyristors.

SUMMARY OF THE INVENTION

The present invention was made in view of the above-described drawbacks.

An object of the invention is to eliminate loss of exposure energy when a print head illuminates the charged surface of a photoconductive drum, and therefore solve the problem of poor printing operation.

Another object of the invention is to provide a print head is particularly useful for a full color image forming apparatus that uses more than one print heads.

A driver circuit drives a plurality of aligned light emitting thyristors. Each light emitting thyristor includes a first terminal, a second terminal, and a first control terminal that causes the light emitting thyristor to turn on and off. The driver circuit includes a common terminal, a first resistor, a second resistor, and a switch. Each light emitting thyristor is disposed at one of a first position where the first terminal is connected to the first potential and the second terminal is connected to the common terminal and a second position where the first terminal is connected to the common terminal and the second terminal is connected to the second potential. The first resistor is connected between the first potential and the common terminal. The second resistor is connected between the common terminal and the second potential. The switch is connected at one of a third position where the switch is connected between the between the first potential and the common terminal and a fourth position where the switch is connected between the common terminal and the second potential. The switch is driven by an ON/OFF command signal to close and open.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 11C illustrates the relation among VDD and a voltage above which the thyristor turns off and below which the thyristor turns on;

DETAILED DESCRIPTION OF THE INVENTION

First Embodiment

Image forming Apparatus

Figure 1:
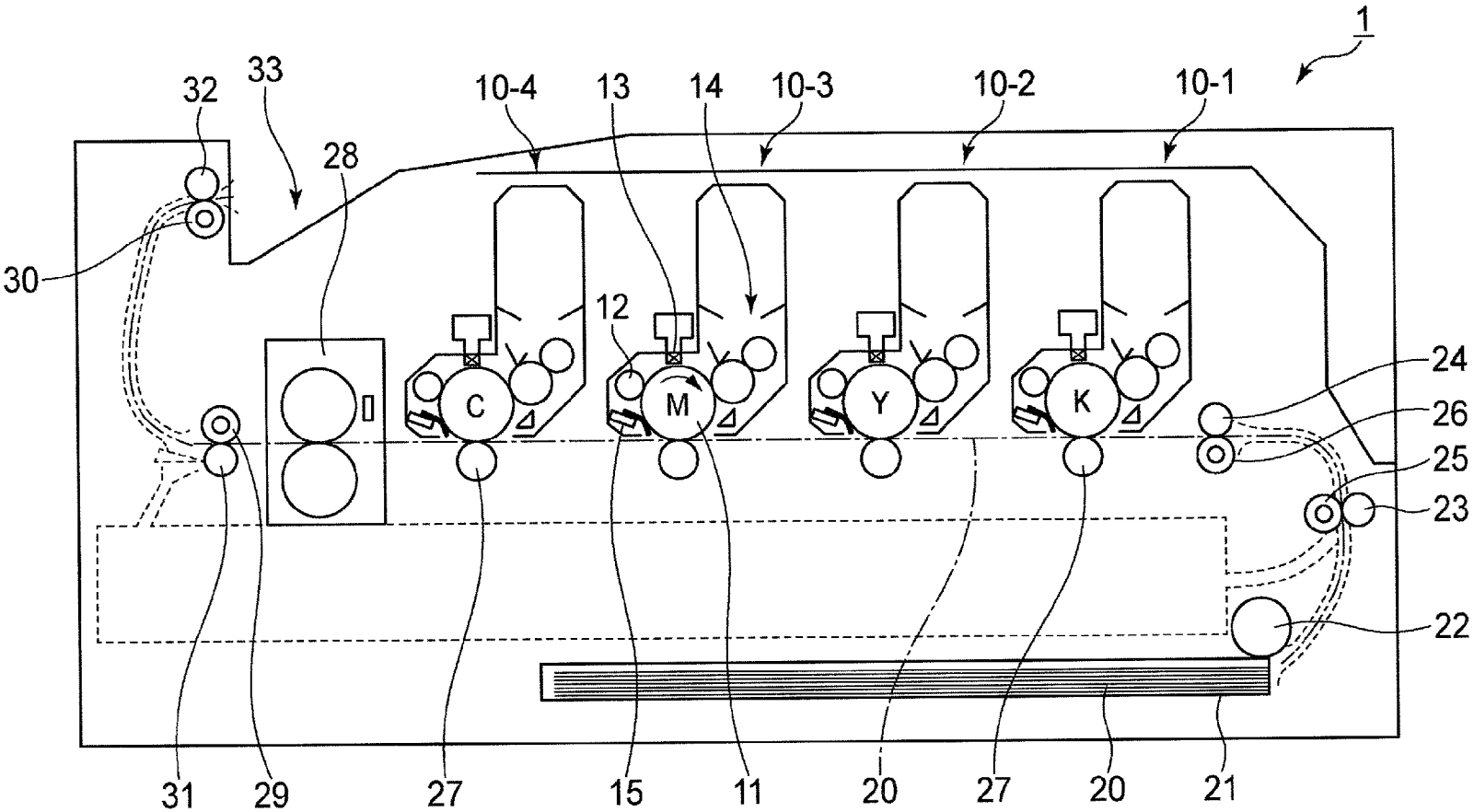
FIG. 1 illustrates the outline of an image forming apparatus according to a first embodiment.

FIG. 1 illustrates the outline of an image forming apparatus 1 according to a first embodiment.

The image forming apparatus 1 is a tandem electrophotographic color printer incorporating four process units 10-1 (black), 10-2 (yellow, Y), 10-3 (magenta, M), and 10-4 (cyan, C). Each process unit has an exposing unit constituted of semiconductor composite devices that incorporate light emitting thyristor arrays. The light emitting thyristors are three-terminal devices. The process units 10-1 to 10-4 are aligned from upstream to downstream along transport path of a recording medium (e.g. paper). Each of the process units 10-1 to 10-4 may be substantially identical; for simplicity only the operation of the process unit 10-3 for forming magenta images will be described, it being understood that the other process units 10-1, 10-2, and 10-4 may work in a similar fashion.

The process unit 10-3 includes a photoconductive body 11 (e.g., photoconductive drum) rotatable in a direction shown by an arrow. The process unit 10-3 further includes a charging unit 12, a print head 131, a developing unit 14, and a cleaning device 15, which are disposed around the photoconductive drum 11 in this order. The charging unit 14 charges the surface of the photoconductive drum 1. The print head 131 selectively illustrates areas in the charged surface of the photoconductive drum 11 to form an electrostatic latent image as a whole. The developing unit 14 deposits magenta toner to the electrostatic latent image to form a magenta toner image. The cleaning device removes residual toner remaining on the photoconductive drum 11 after transfer of the toner image onto the recording medium. The photoconductive drum 1 and associated rolling members are driven in rotation by a drive source (not shown) via, for example, a gear train (not shown).

A paper cassette 21 is disposed at a lower part of the image forming apparatus 1, and holds a stack of paper 20 therein. A hopping roller 22 is disposed over the paper cassette 21 and feeds the paper 20 on a page-by-page basis into the transport path. A pinch roller 23 and a transport roller 25 are disposed downstream of the hopping roller 22, and cooperate with each other to hold the paper 20 in a sandwiched relation. A pinch roller 24 and a registry roller 25 cooperate with each other to hold the paper in a sandwiched relation, and correct skew of the paper 20. The hopping roller 22, transport roller 25, and registry roller 26 are driven in rotation by a drive source (not shown).

Transfer rollers 27 are formed of an electrically conductive rubber material, and are disposed such that each transfer roller 27 parallels a corresponding photoconductive drum 11. A high voltage is applied to the transfer roller 27 to develop an electric field across the photoconductive drum 11 and the transfer roller 27, thereby transferring the toner image from the photoconductive drum 11 onto the paper 20.

A fixing unit 28 is located downstream of the process unit 10-4. The fixing unit 28 includes a heat roller and a pressure roller. When the paper 20 carrying a toner image thereon passes through the gap formed between the heat roller and pressure roller, the toner image is fused by pressure and heat. Discharge rollers 29 and 30 and pinch rollers 31 and 32 are disposed downstream of the fixing unit 28, and transport the paper 20 to a stacker 33. The heat roller, pressure roller, discharge roller 29 are driven in rotation by a drive source (not shown).

The image forming apparatus 1 of the aforementioned configuration operates as follows: The hopping roller 22 feeds the paper 20 into the transport path on a page-by-page basis. The paper 20 is held by the transport roller 25, registry roller 26, pinch rollers 23 and 24 in a sandwiched relation and is transported to the gap formed between the photoconductive drum 11 of the process unit 10-1 and the transfer roller 27. The paper 20 is then pulled in between the photoconductive drum 11 and the transfer roller 27, and is further transported as the photoconductive drum 11 rotates while at the same time transferring the toner image onto the paper 20. Likewise, the paper 20 passes through the process units 10-2 to 10-4 in sequence so that the toner images of the respective colors are transferred onto the paper 20 in registration.

As the paper 20 passes through the fixing unit 28', the toner images are fused by using heat and pressure. Then, the paper 20 is further transported by the discharge rollers 29 and 30 and pinch rollers 31 and 32, and is discharged onto the stacker 33. This completes formation of a full color image.

Print Head

Figure 2:
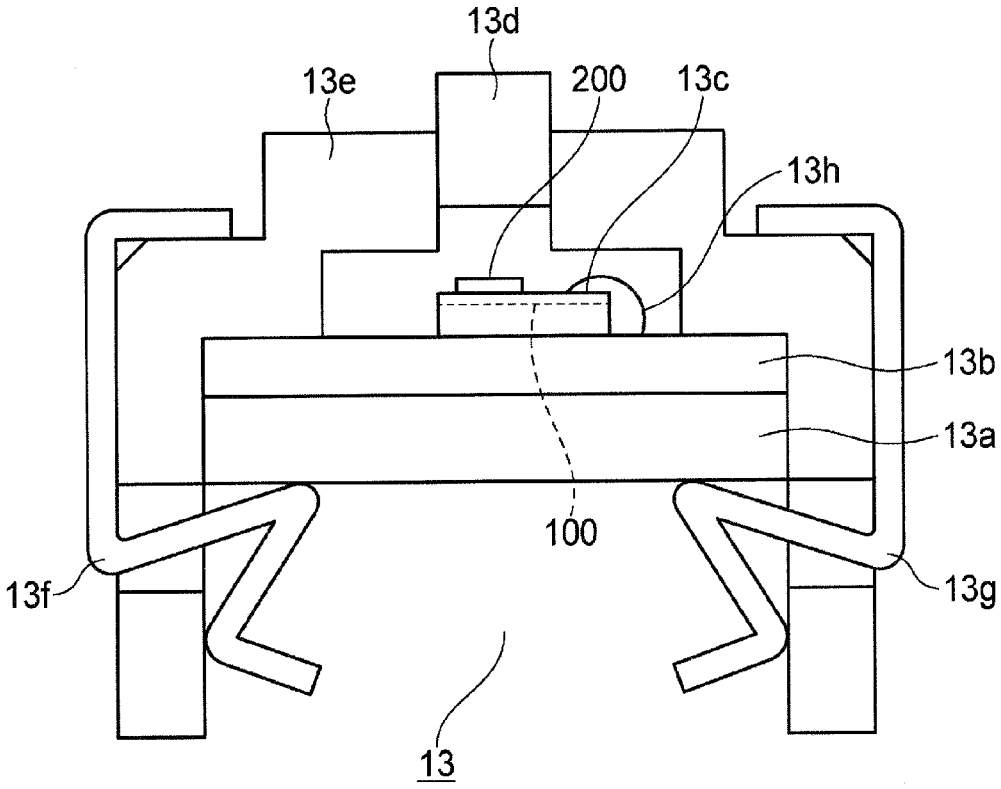
FIG. 2 is a cross-sectional view of a print head shown in FIG. 1.
Figure 3:
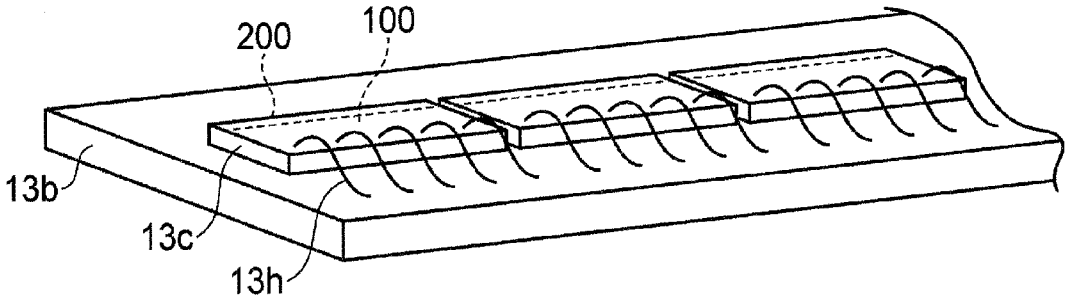
FIG. 3 is a perspective view of a printed circuit board unit of the print head.

FIG. 2 is a cross-sectional view of the print head 131 shown in FIG. 1. FIG. 3 is a perspective view of a printed circuit board unit of the print head 131.

The print head 131 includes a base 13*a* and the printed circuit board unit mounted on the base 13*a*. The printed circuit board unit includes integrated circuit chips (IC) 13*c* bonded onto the printed circuit board 13*b*. Each IC chip 13*c* includes a self-scanning circuit 100 and light emitting elements 200 (e.g., 210-1 to 210-n) aligned substantially in a straight line. A plurality of terminals (not shown) of the IC chips 13*c* and wiring pads (not shown) are formed on the wiring board 13*b*, and are electrically connected by means of bonding wires 13*h*.

A lens array (e.g., rod lens array) 13*d* includes a plurality of column-shaped optical elements, and is disposed over the light emitting elements 200. The rod lens array 13*d* is secured in position by a holder 13*e*. The base 13*a*, print wiring board 13*b*, and holder 13*e* are secured together by means of clamping members 13*f* and 13*g*.

Control Circuit

Figure 4:
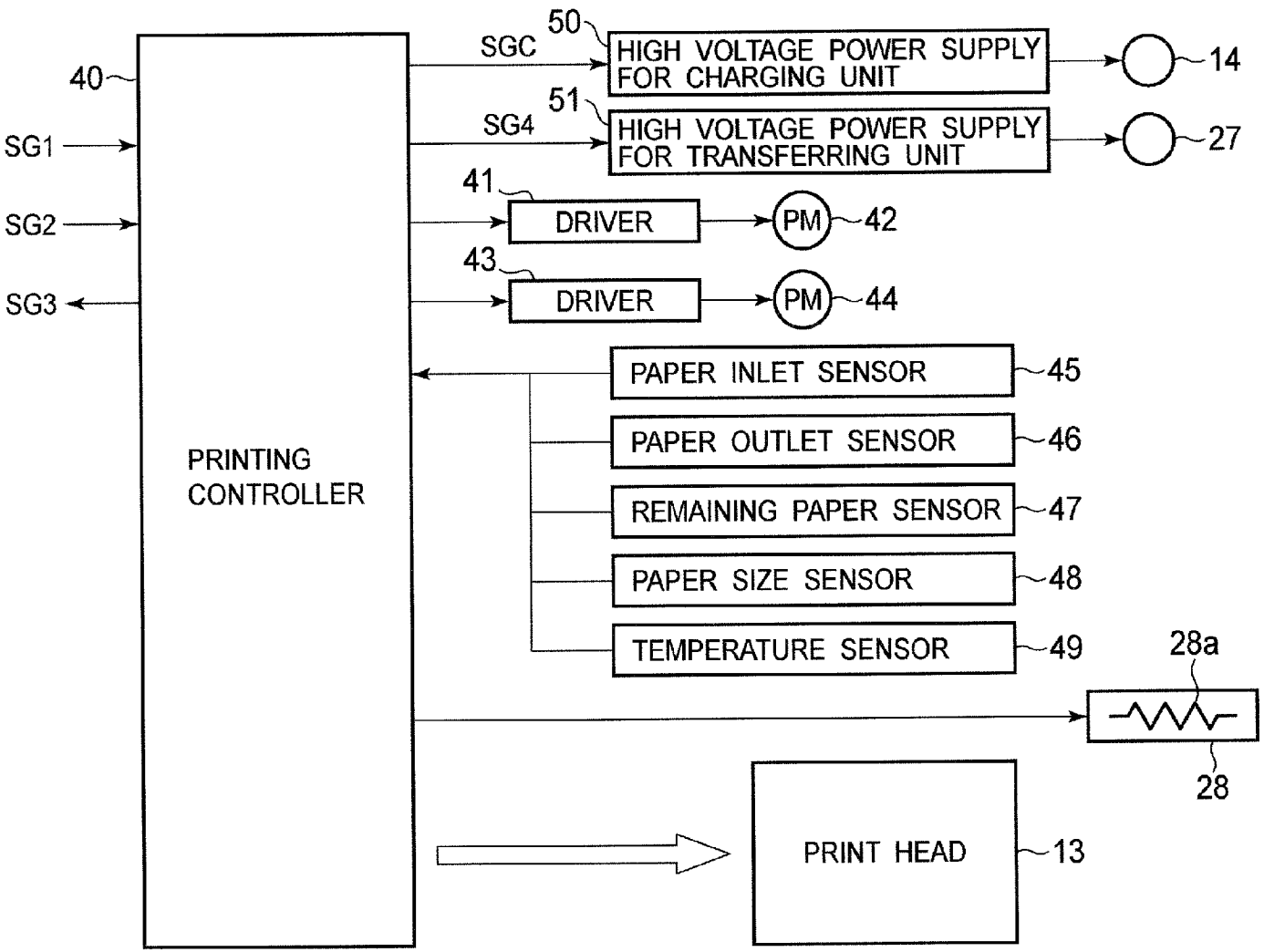
FIG. 4 is a block diagram illustrating the general configuration of a printer controlling system for the image forming apparatus.

FIG. 4 is a block diagram illustrating the general configuration of a printer controlling system for the image forming apparatus 1. FIG. 4 illustrates a printer controlling system for controlling the process unit 10-3 by way of example.

The printer controller includes a printing controller 40 for controlling the printing operation performed by a print engine. The printing controller 40 includes a microprocessor, read only memory (ROM), a random access memory (RAM), a timer, and an I/O port through which signals and data are inputted and outputted. The printing controller 40 performs sequence control based on control signal SG1 and video signal (dot map data aligned in a single dimension) SG2 received from a host apparatus (not shown), thereby performing a printing operation. The printing controller 40 is connected to the print heads 131 of the four process units 10-1 to 10-4, a heater 28*a* of the fixing unit 28, drivers 41 and 43, a paper inlet sensor 49, a paper outlet sensor 46, a remaining paper sensor 47, a paper size sensor 48, a temperature sensor 49, a high voltage power supply for charging unit 50, and a high voltage power supply for transferring unit 51. The driver 41 drives a developing/transferring process motor (PM) 42 to rotate. The driver 43 drives a paper transporting motor (PM) 44 to rotate. The high voltage power supply for charging unit 50 is connected to the developing unit 14. The high voltage power supply, 51, for transferring unit 51 is connected to the transfer rollers 27.

The printer control system operates as follows:

Upon reception of the control signal SG1 from a host controller, the printing controller 40 detects by means of the temperature sensor 49 whether the heater 28*a* of the fixing unit 28 is within a usable temperature range. If the temperature has not been within the usable range yet, the heater 28*a* is energized to heat the fixing unit 28. The printing controller 40 drives the driver 41 to cause the developing/transferring process motor 42 to rotate, while also sending a charge signal SGC to the high voltage power supply for charging unit, 50, so that the high voltage power supply for charging unit, 50, turns on for charging the developing unit 14.

The remaining paper sensor 47 detects the presence of the paper 20 shown in FIG. 2, and the paper size sensor 48 detects the type of the paper 20, so that the appropriate type of paper is fed into the transport path. The driver 43 is configured to drive the paper transport motor 44 to rotate in either a forward direction or a backward direction. Initially, the paper transport motor 44 rotates in the backward direction to transport the paper 20 over a predetermined distance until the paper inlet sensor 45 detects the paper 20. Subsequently, the paper transport motor 44 rotates in the forward direction to transport the paper 20 into the print engine.

Figure 6:
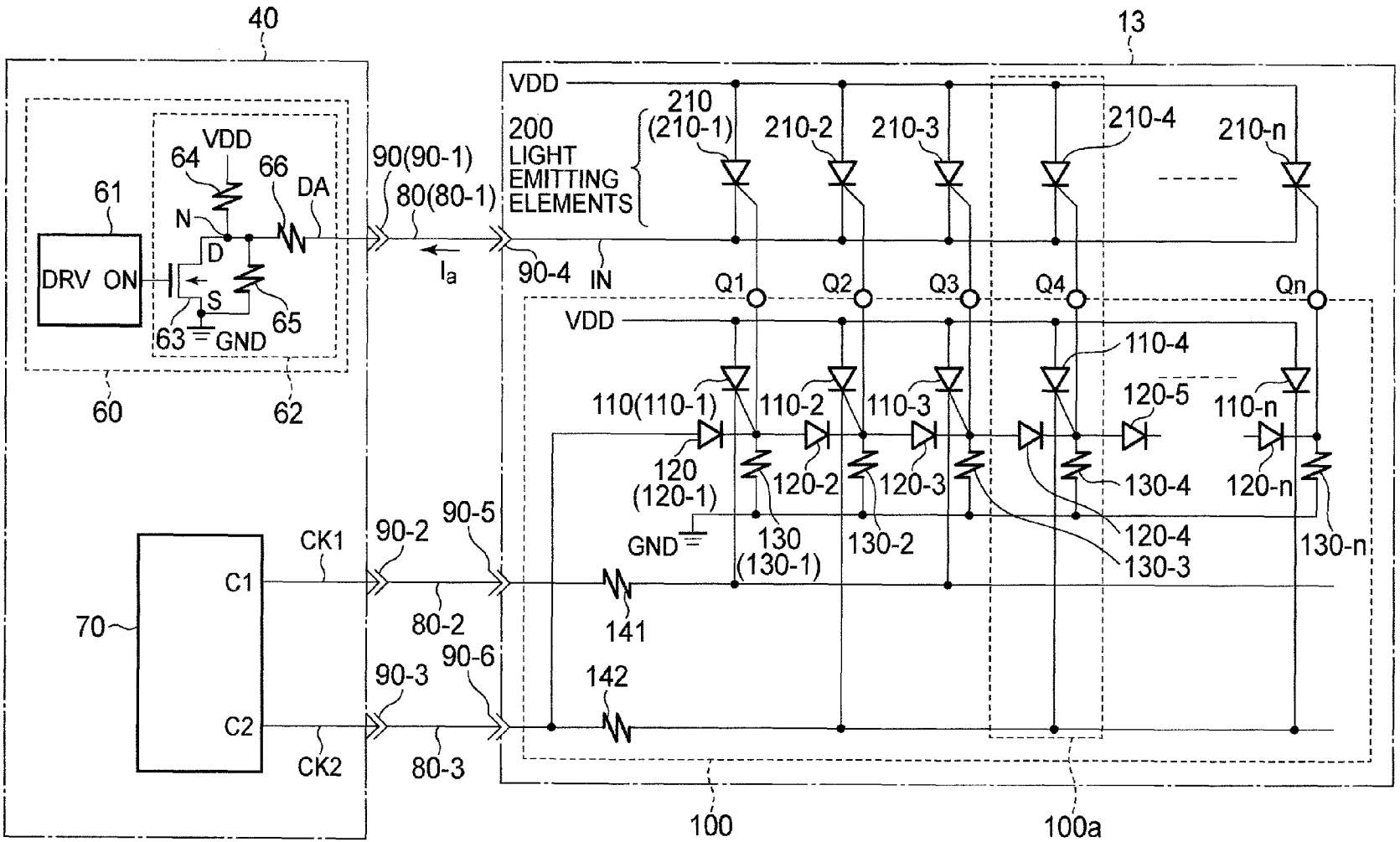
FIG. 6 is a schematic diagram illustrating the configuration of the print head.

Once the paper 20 has reached to a position where printing can be started, the printing controller 40 sends a timing signal SG3 (including main scanning sync signal and sub scanning sync signal), and receives the video signal SG2. An image processing section edits the video signal SG2 on a page-by-page basis and sends it to the printing controller 40. The printing controller 40 sends the received signal SG2 to the respective print heads 131. The respective print heads 131 have the scanning circuit 100 (FIG. 6) and light emitting elements 200 (FIG. 6).

The video signal SG2 is transmitted and received on a line-by-line basis. Each print head 131 illuminates the negatively charged surface of a corresponding photoconductive drum 11 in accordance with the signal SG2 to form an electrostatic latent image in the form of dots on the photoconductive drum 11. The potential of the illuminated areas becomes less negative. The negatively charged toner is attracted to the respective dots of the electrostatic latent image by the electric field, thereby developing the electrostatic latent image into a toner image.

As the photoconductive drum 11 rotates, the toner image approaches a transfer point defined between the photoconductive drum 11 and the transfer roller 27. The transfer signal SG4 causes the high voltage power supply for charging, 51, to turn on, so that the toner image is transferred onto the paper 20 as the paper 20 passes through the transfer point. The paper 20 carrying the toner image thereon then passes through a fixing point defined between the heat roller and pressure roller of the fixing unit 28. The toner image is fused by using heat and pressure. The paper 20 is then further transported from the printing mechanism, passing the paper outlet sensor 46 to be discharged to the outside of the printer.

In response to the detection signal from the paper size sensor 48 and paper inlet sensor 45, the printing controller 40 causes the high voltage power supply for transferring, 51, to apply high voltage to the transfer rollers 27 while the paper 20 is passing the transfer points. When the paper 20 is transported past the outlet paper sensor 46 after completion of printing, the printing controller 40 causes the high voltage power supply for charging, 50, to terminate applying the voltage to the developing unit 14 and causes the developing/transferring process motor 42 to terminate rotating. The above-described sequence of operations is repeated for each page of the paper 20.

Print Head

Figure 5:
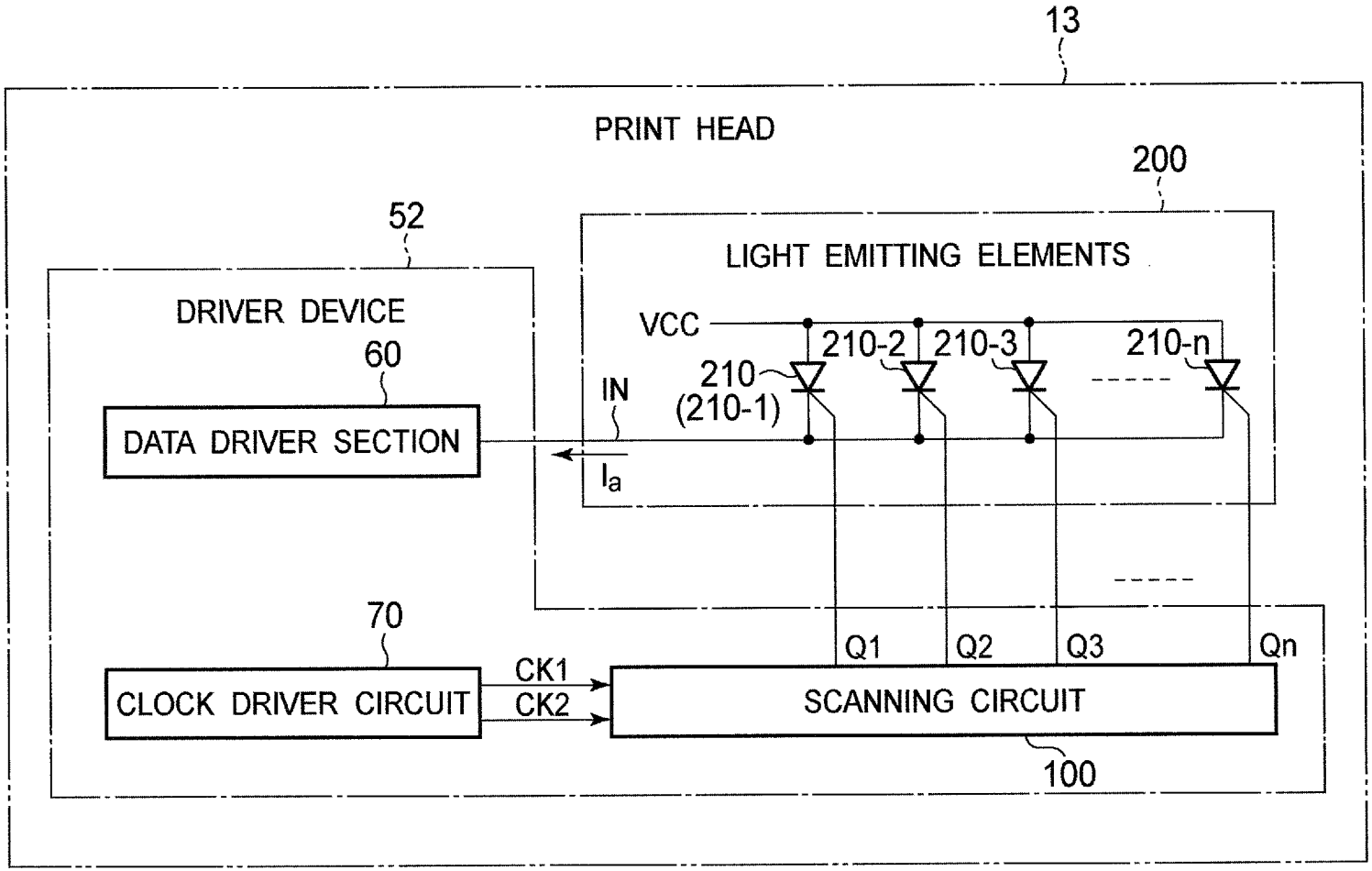
FIG. 5 is a block diagram illustrating the general configuration of the print head shown in FIG. 4.

FIG. 5 is a block diagram illustrating the general configuration of the print head 131 shown in FIG. 4.

The print head 131 includes the light emitting elements 200 constituted of IC chips 13*c* shown in FIG. 4 and a driver device 52 that drives the light emitting elements 200. The driver device 52 is fabricated in the IC chip 13*c*. The driver device 52 includes the main scanning circuit 100, a data driver section 60, and a clock driver circuit 70. The scanning circuit 100 outputs a two-phase clock signal for scanning the light emitting elements 200: first clock C1 and second clock C2 outputted from corresponding output terminals Q1 to Qn. The data driver section 60 sets the common terminal IN of the light emitting elements 200 either to High level or to Low level. The clock driver circuit 70 generates the first and second clocks for driving the scanning circuit 100, and outputs the first and second clocks from a first clock terminal CK1 and a second clock terminal CK2, respectively.

The light emitting elements 200 are P-gate light emitting thyristors 210-1 to 210-n, which are positive gate three-terminal thyristors. The light emitting thyristor has an anode, a cathode, and a gate. The anode is connected to a supply voltage VDD as a first power supply (e.g., that supplies a supply voltage VDD of 3.3 V) and the cathode is connected to the data driver section 60 via the common terminal IN through which anode current Ia flows. The gate is connected to a corresponding one of the output terminals Q1 to Qn. When the supply voltage VDD is applied across the anode and cathode, if a triggering signal (trigger current) is applied to the gate, the anode-cathode of the thyristor conducts so that current flow through the thyristor to emit light.

FIG. 6 is a schematic diagram illustrating the configuration of the print head 131.

FIG. 6 shows the driver section 60 and clock driver circuit 70 as a part of the printing controller 40 for convenience of explanation. Of course, the data driver section 60 and clock driver circuit 70 may be disposed within the print head 131.

The print head 131 shown in FIG. 6 includes the scanning circuit 100 and light emitting elements 200 formed in the IC chip 13*c* (FIG. 3). The scanning circuit 100 and light emitting elements 200 are connected to the data driver section 60 and clock driver circuits 70 via a plurality of cables 80-1 to 80-3 and a plurality of connectors 90-1 to 90-6.

Each light emitting thyristor 210 has its anode connected to the supply voltage VDD, its cathode connected to the connector 90-4 via the common terminal IN, and its gate connected to a corresponding one of the output terminals Q1 to Qn. The print head 131 uses a total of 4992 light emitting thyristors aligned in a line to print an image having a resolution of 600 dots per inch (600 dpi) on A4 size paper.

The scanning circuit 100 is driven by a two-phase clock signal, i.e., the first clock C1 and second clock C2 supplied from the clock driver circuit 70, thereby controlling the trigger current to turn on and off the light emitting elements. The first clock C1 is supplied via the first clock terminal CK1, connector 90-2, cable 80-2, and connector 90-5. The second clock C2 is supplied via the second clock terminal CK2, connector 90-3, cable 80-3, and connector 90-6. The scanning circuit 100 includes a plurality of stages of 3-terminal thyristors (e.g., P gate scanning thyristor having a PNPN layer)

110-1 to 110-n (e.g., n=4992), a plurality of diodes 120-2 to 120n, and a plurality of resistors 130-2 to 130-n, and operates as a self-scanning shift register.

Each scanning thyristor 110 has an anode connected to the supply voltage VDD, a cathode, and a gate connected to the gate of a corresponding light emitting thyristor 210 via a corresponding one of the output terminals Q1 to Qn and to the ground GND as a second supply voltage through a corresponding one of resistors 130-1 to 130-n.

The cathodes of odd-numbered scanning thyristors 110-1, 110-3, 110-5, . . . , 100-(n−1) are connected to the connector 90-5 through a resistor 141. The cathodes of even-numbered scanning thyristors 110-2, 110-4, 110-6, . . . 100-n are connected to the connector 90-6 through a resistor 142. Each of the diodes 120-2 to 120-n has an anode connected to the gate of a preceding scanning thyristor of two adjacent scanning thyristors and a cathode connected to the gate of a following scanning thyristor of the two adjacent scanning thyristors, so that the scanning thyristors 110-1 to 110-n are turned on in sequence from left to right in FIG. 6.

The scanning thyristors 110-1 to 110-n and light emitting thyristors 210-1 to 210-n are configured to have an identical structure of semiconductor layers, and operate substantially in the same manner. The light emitting thyristors 210-1 to 210-n are designed to emit light while the scanning thyristors 110-1 to 110-n do not need to emit light. Therefore, the scanning thyristors 110-1 to 110-n are covered with, for example, a metal film which is not transparent to light.

The scanning thyristors 100-1 to 100-n are selectively turned on in response to the two-phase clock signal, i.e., first clock C1 and second clock C2 received via the first clock terminal CK1 and the second clock terminal CK2, respectively. The ON state of a scanning thyristor is transmitted to a corresponding light emitting thyristor that should be turned on. Also, the ON state of the scanning thyristor 110 is transmitted to the next adjacent scanning thyristor 110 on the first clock C1 and second clock C2, so that the scanning thyristors 110-1 to 110-n serve as a shift register as a whole.

The circuit 100*a* shown by dotted lines is a minimum unit which is a combination of a scanning circuit 100 and a corresponding light emitting thyristor 210. Therefore, the print head 131 can be thought of as a collection of a total of n minimum units cascaded in order as shown in FIG. 6.

The data driver section 60 generates an ON/OFF command signal DRVON for driving the light emitting thyristors 210-1 to 210-n, thereby causing the anode current Ia to flow through the light emitting thyristors in a time division manner. The clock driver circuit 70 generates the two-phase clock signal, i.e., first clock C1 and second clock C2 and outputs the first clock C1 and second clock C2 to the scanning circuit 100 from the first clock terminal CK1 and second clock terminal CK2.

FIG. 6 shows only one data driver section 60 for simplicity. A total of 4992 light emitting thyristors 210-1 to 210-n are employed, and divided in groups, each group being driven by a corresponding driver circuit 60, so that the light emitting thyristors 210-1 to 210-n are driven in a time division manner.

The following is a typical design of the print head 131. A total of 26 chips of light emitting thyristor arrays are aligned on a printed circuit board shown in FIG. 4, each chip including a total of 192 light emitting thyristors 210. Thus, the print head 131 includes a total of 4992 light emitting thyristors 210-1 to 210-n, . . . , 210-4992. Each data driver section 60 corresponds to the 26 chips of light emitting thyristors and has a total of 26 output terminals.

The clock driver circuit 70 drives the chips of the scanning circuit 100 in the form of an array. For high speed operation of the print head 131, the clock driver circuit 70 is preferably formed in the scanning circuit 100. In addition, if the print head 131 may operate at low speed, the first clock terminal CK1 and second clock terminal CK2 may be connected in parallel with a plurality of the scanning circuits 100, so that the scanning circuit 100 may be shared.

The data driver section 60 includes a data control circuit 61 that generates the ON/OFF command signal DRVON and a data driver circuit 62 that drives the light emitting elements 200 in accordance with the ON/OFF command signal DRVON. The data driver circuit 62 includes an NMOS 63 as a switch element that is connected between a node N and the ground GND and is driven to turn on and off in accordance with the ON/OFF command signal DRVON, a first voltage dividing resistor 64 connected between the supply voltage VDD and the node N, and a second voltage dividing resistor 65 connected between the node N and the ground GND.

For example, if the ON/OFF command signal DRVON outputted from the data control circuit 61 is at the LOW level, the NMOS transistor 63 turns off, so that the resistor 64 pulls up the potential at the data terminal DA to the HIGH level. This HIGH level is equal to the supply voltage VDD divided by the resistors 64 and 65. The HIGH level at the data terminal DA causes the anode-cathode voltage of the light emitting thyristors 210-1 to 210-n to decrease, thereby causing all the light emitting thyristors 210-1 to 210-n not to emit light.

If the ON/OFF command signal DRVON is at the High level, the NMOS transistor 63 turns on, causing the potential at the data terminal DA to decrease to substantially the ground GND. Therefore, if the light emitting thyristors 210 are in the OFF state, the potential at the data terminal DA brings the cathode of the light emitting thyristors 210-1 to 210-n to the LOW level through the connector 90-1, connector 90-4, and the common terminal IN. This voltage is substantially equal to the supply voltage VDD applied across the cathode and anode of the light emitting thyristors 210-1 to 210-n.

The supply voltage VDD for the data driver section 60 and clock driver circuit 70 is the same as the supply voltage VDD for the light emitting elements 200 and scanning circuit 100. The supply voltage VDD is, for example, 3.3 V.

Light Emitting Thyristor

Figure 7A:
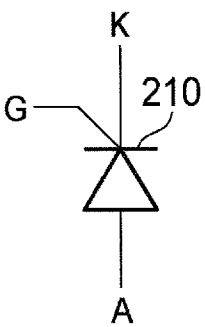
FIG. 7A shows the circuit symbol of a light emitting thyristor having three terminals.
Figure 7B:
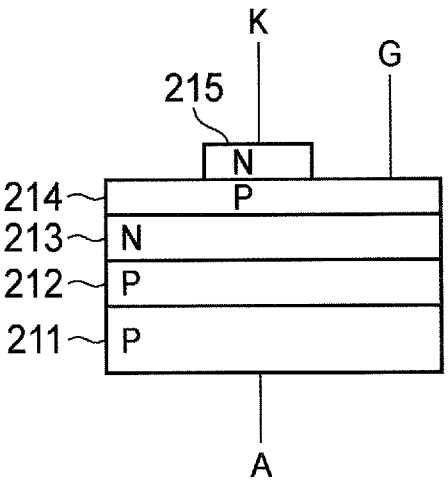
FIG. 7B is a cross sectional view of the light emitting thyristor.
Figure 7C:
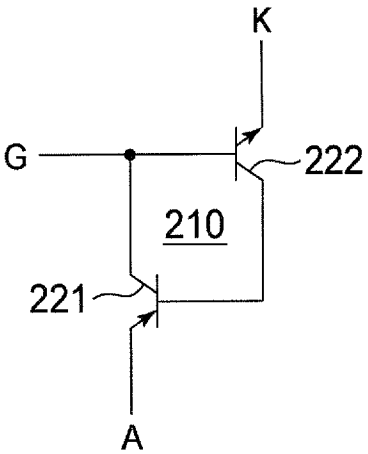
FIG. 7C illustrates an electrical equivalent circuit of the light emitting thyristor shown in FIG. 7B.

FIGS. 7A-7C illustrate the structure of the light emitting structure 210 shown in FIG. 6.

FIG. 7A shows the circuit symbol of the light emitting thyristor 210 having three terminals: anode A, cathode K, and gate G.

FIG. 7B is a cross sectional view of the light emitting thyristor 210. The light emitting thyristor 210 may be fabricated by epitaxially growing a crystal structure on a P type GaAs wafer 211 by conventional metal organic chemical vapor deposition (MO-CVD).

The following layers are formed on the N type GaAs wafer 211: a P-type layer 212 that contains a P-type impurity, an N-type layer 213 that contains an N-type impurity, and a P-type layer 214 that contains a P-type impurity in this order. In this manner, a PNPN structure or a four-layer structure of AlGaAs is fabricated. Grooves (not shown) are then formed in the wafer to isolate individual devices by a known etching technique.

When etching is performed, apart of the P-type layer 214 is etched to expose. A metal wiring is formed on the exposed region to form a gate G. The uppermost N-type layer 215 is partially exposed and a metal wiring is formed on the exposed region to form a cathode K. A metal wiring is formed on a side of the P-type layer 211 opposite the P-type layer 212, thereby forming an anode A.

The scanning thyristors 110 shown in FIG. 6 have the same internal structure as the light emitting thyristors 210.

FIG. 7C illustrates an electrical equivalent circuit of the light emitting thyristor 210 shown in FIG. 7B. The light emitting thyristor 210 is constituted of a PNP transistor 221 and an NPN transistor 222. The emitter of the PNP transistor 221 corresponds to the anode A of the light emitting thyristors 210, and the base of the NPN transistor 222 corresponds to the gate G. The emitter of the NPN transistor 222 corresponds to the cathode K. The collector of the PNP transistor 221 is connected to the base of the NPN transistor 222. The base of the PNP transistor 221 is connected to the collector of the NPN transistor 222.

The light emitting thyristor 210 shown in FIGS. 7A-7C has an AlGaAs layer formed on the GaAs wafer 211. The thyristor 210 is not limited to this configuration. The thyristor 210 may have a layer of GaP, GaAsP, AlGaInP or InGaAsP formed on the GaAs wafer. Alternatively, the thyristor 210 may have a GaN layer, an AlGaN layer, or an InGaN layer formed on a silicon substrate or a sapphire substrate.

{Brief Description of Operation of Print Head}

Referring back to FIG. 6, if the first clock C1 goes low (Low level) and is outputted from the first clock terminal CK1, the first clock C1 is fed to the cathode of the scanning thyristor 110-1 through the connector 90-2, cable 80-2, connector 90-5, and resistor 141. Thus, the voltage of the cathode K goes low. If the second clock C1 goes high (High level) and is outputted from the first clock terminal CK1, the second clock C2 is fed to the gate of the scanning thyristor 110-1 through the connector 90-3, cable 80-3, connector 90-6, and diode 120-1. Thus, a triggering current flows through a gate-cathode current path, causing the scanning thyristor 110-1 to turn on. Thus, the self-scanning circuit 100 initiates its shift operation so that the gate of the succeeding stages of the scanning thyristors 110-2 to 110-n goes high (High level), to turn on the scanning thyristors in sequence.

It is to be noted that a scanning thyristor (e.g., 110-2) that has been turned on has its gate at the High level, i.e., at substantially the same voltage as the supply voltage VDD. The light emitting thyristor (e.g., 210-2) corresponding to the scanning thyristor has its anode connected to the supply voltage VDD. If the cathode of the light emitting thyristor (e.g., 210-2) goes low (Low level) in sequence, voltage is applied across the cathode and anode of the light emitting thyristor 210-2.

Since the gate of the scanning thyristor 110-2 is connected to the gate of the light emitting thyristor 210-2, these two gates are at the same potential. The gate of the light emitting thyristor 210-2 is selected to be energized and goes high, the trigger current flows from gate to cathode of the light emitting thyristor 210-2 causing the light emitting thyristor 210-2 to turn on. The current flowing through the cathode of the light emitting thyristor 210-2 is an anode current Ia that flows into the data terminal DA. Thus, the light emitting thyristor 210-2 emits light in accordance with the anode current Ia.

{Detailed Operation of Print Head}

Figure 8:
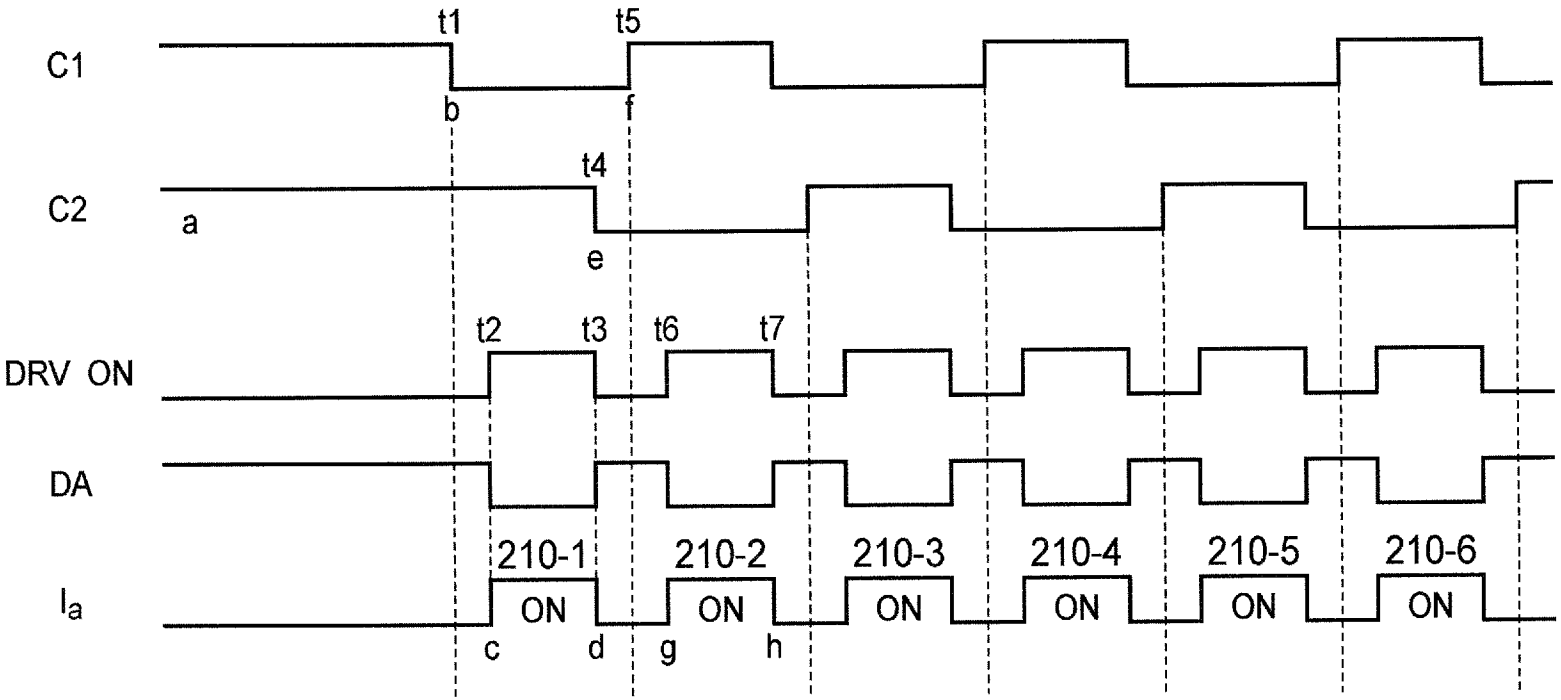
FIG. 8 is a timing chart illustrating the details of the operation of the print head shown in FIG. 1.

FIG. 8 is a timing chart illustrating the details of the operation of the print head 131 shown in FIG. 1.

FIG. 8 illustrates the waveform of respective signals when the light emitting thyristors 210-1 to 210-n (e.g., n=6) are turned on alternately one at a time in a single scanning line.

The scanning circuit 100 using scanning thyristors 110 operates on the two-phase clock signal outputted from the first and second clock terminals CK1 and CK2. The two-phase clock signal is driven by the clock driver circuit 70 having the first and second output terminals CK1 and CK2.

Before time t1 shown in FIG. 7, the first and second clocks C1 and C2 are the High level, and are outputted from the first and second clock terminals CK1 and CK2, respectively. The high level first clock C1 is fed to the cathodes of odd-numbered scanning thyristors 110-1, 110-3, 110-5, . . . 110-(n−1) through the resistor 141 and the high level second clock C2 is fed to the cathodes of even-numbered scanning thyristors 110-2, 110-4, 110-6, . . . , 110-n through the resistor 142.

Therefore, the anode-cathode voltage of the odd-numbered scanning thyristors 110-1, 110-3, 110-5, . . . 110-(n−) is substantially zero volts so that no anode current flows causing the odd-numbered scanning thyristors 110-1, 110-3, 110-5, . . . 110-(n−1) to turn off. Likewise, the anode-cathode voltage of the even-numbered scanning thyristors 110-2, 110-4, 110-6, . . . 110-(n) is also substantially zero volt so that no anode current flows causing the even-numbered scanning thyristors 110-2, 110-4, 110-6, . . . 110-(n) to turn off. As a result, all the scanning thyristors 110-1 to 110-n in the scanning circuit 100 are off.

Before time t1 shown in FIG. 7, the ON/OFF command signal DRVON, outputted from the data control circuit 61, is at the Low level. If the NMOS transistor 63 is OFF, the data terminal DA is at the High level. The High level at the data terminal DA is fed to the cathodes of the respective light emitting thyristors 210-1 to 210-n through the connector 90-1, cable 80-1, connector 90-4, and common terminal IN. The anode of the light emitting thyristors 210-1 to 210-n are at the supply voltage VDD and therefore the anode-cathode voltage of the respective thyristors 210-1 to 210-n is substantially zero volts, causing the anode current 1*a* to become zero, so that none of the light emitting thyristors 210-1 to 210-n emits light. A description will be given of the process for turning on the scanning thyristors 110-1 in the first stage scanning circuit and the scanning thyristors 110-1 to shut off in the second stage scanning circuit, respectively.

Phase I: Turning-on of Thyristor 110-1

At time t1 shown in FIG. 8, the first clock C1 goes low as depicted at "b" and the second clock C2 is at the High level. The high level second clock C2 is fed to the gate of the scanning thyristor 110-1 through the diode 120-1, causing a trigger current to flow through the gate-cathode junction of the scanning thyristor 110-1 back to the clock terminal CK1. Thus, the scanning thyristor 110-1 turns on.

At time t2, the ON/OFF command signal DRVON goes high and is fed to the data driver circuit 62. Thus, the NMOS transistor 63 turns on so that the data terminal DA goes low (Low level) through the resistor 66. Therefore, voltage substantially equal to the supply voltage VDD is applied across the anode-cathode junction of the light emitting thyristor 210-1. At this time, the scanning thyristor 110-1 has turned on, the gate potential of the scanning thyristor 110-1 is substantially equal to the supply voltage VDD.

The scanning thyristor 110-1 and light emitting thyristor 210-1 have the same gate potential. The gate potential of the scanning thyristor 110-1 that has turned on is substantially equal to the supply voltage VDD. When the potential of the data terminal DA goes low, the cathode potential of the light emitting thyristor 210-1 is also at the Low level (substantially zero volts) so that the gate-cathode voltage of the light emitting thyristor 210-1 causes a gate current to flow. Thus, the light emitting thyristor 210-1 turns on. As a result, a anode current Ia flows through the cathode of the light emitting thyristor 210-1 as depicted at "c," so that the light emitting thyristor 210-1 emits light in accordance with the anode current Ia.

At time t3, the ON/OFF command signal DRVON goes low. This low level is fed to the data driver circuit 62, causing the NMOS transistor 63 to go off. When the NMOS transistor 63 goes off, the potential of the data terminal DA goes high, so that the anode-cathode voltage of the light emitting thyristor 210-1 decreases. This causes the anode current path to shut off so that the light emitting thyristor 210-1 turns off and therefore the anode current Ia becomes substantially zero as depicted at "d."

The light emitting thyristor 210-1 emits light to form an electrostatic latent image on the photoconductive drum 11 shown in FIG. 1. The exposing energy is determined by the exposing time (i.e., time t3 to time t2) times the light power produced by the anode current Ia. The light power may vary due to variations in manufacturing process, but the exposing time for individual thyristors may be adjusted to compensate for the variations of light power. If the light emitting thyristor 210-1 is not to be turned on, the ON/OFF command signal DRVON can be maintained high for a period of time from time t2 to time t3. In this manner, the ON/OFF command signal DRVON can drive the light emitting thyristors 210-1 to emit or not to emit light.

{Turning on of Self-Scanning Thyristor 110-2}

At time t4, the second clock C2 goes low as depicted at "e." Immediately before time t4, the scanning thyristor 110-1 is in the ON state and the gate of the scanning thyristor 110-1 is at the High level. This high level is fed to the gate of the scanning thyristor 110-2 through the diode 120-2, causing the gate current to flow through the gate-cathode junction of the scanning thyristor 110-2 into the clock terminal CK2. As a result, the scanning thyristor 110-2 turns on.

At time t5, the first clock C1 outputted from the clock terminal CK1 goes high as depicted at "f." The High level on the clock terminal CK1 causes the anode current path of the scanning thyristor 110-1, thereby turning off the scanning thyristor 110-1.

At time t6, the ON/OFF command signal DRVON goes high, causing the potential on the data terminal DA to go low. When the potential on the data terminal DA becomes low, a voltage substantially equal to the supply voltage VDD is applied across the anode-cathode junction of the light emitting thyristor 210-2. At time t6, the scanning thyristor 110-2 is in its ON state and the scanning thyristor 110-1 is in its OFF state. The scanning thyristor 110-2 and the light emitting thyristor 210-2 have their gate electrodes connected together, so that the scanning thyristor 110-2 and light emitting thyristor 210-2 turn on and off simultaneously. Thus, the anode current Ia flows through the cathode of the light emitting thyristor 210-2 as depicted at "g," causing the light emitting thyristor 210-2 to emit light in accordance with the anode current Ia.

At time t7, the ON/OFF command signal DRVON goes low and the data terminal DA goes high, which shuts off the current path for the cathode current of the light emitting thyristor 210-2, causing the anode current Ia to decrease to substantially zero as depicted at "h."

Likewise, the scanning thyristors 110-2 to 110-n can be turned on in sequence on the first and second clocks C1 and C2. As described above, the ON/OFF command signal DRVON having the High level is applied to the scanning thyristors 110-1 to 110-n in sequence, so that the light emitting thyristors 210-1 to 210-n corresponding to the scanning thyristors 110-1 to 110-n, respectively, are selectively caused to emit light.

{Comparison Between First Embodiment and Comparative Example}

Figure 9A:
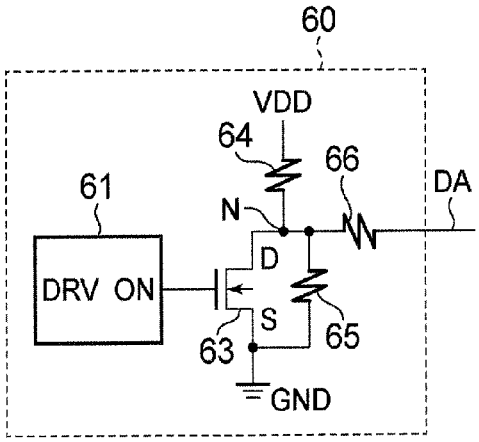
FIG. 9A illustrates a data driver section according to the first embodiment.
Figure 9B:
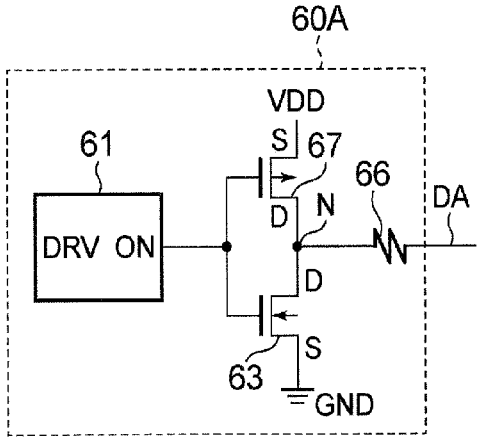
FIG. 9B illustrates a data driven section according to a comparative example.

FIG. 9A illustrates the data driver section 60 according to the first embodiment, and FIG. 9B illustrates a data driver section 60A according to a comparative example.

The data driver section 60A includes a data control circuit 61 and an inverter formed of complementary MOS transistors (referred to as CMOS inverter herein after) connected to the output of the data control circuit 61. The CMOS inverter includes an NMOS transistor 63 and a PMOS transistor 67 which are connected in series between the supply voltage VDD and the ground GND. The NMOS transistor 63 and PMOS transistor 67 have their gates connected to the output of the data control circuit 61 and their drains connected to a node N and then to the data terminal through a resistor 66. The CMOS inverter receives the ON/OFF command signal DRVON from the data control circuit 66, and inverts the ON/OFF command signal DRVON, outputting the inverted ON/OFF command signal DRVON to the data terminal DA through the resistor 66.

Referring FIG. 9A, if the NMOS transistor 63 is in the ON state, the potential on the data terminal DA of the data driver section 60 is substantially equal to that of the ground GND. If the NMOS transistor 63 is in the OFF state, the potential on the data terminal DA is equal to the supply voltage VDD divided by the resistors 64 and 65. Thus, the High level output in the data driver section 60A is lower than the supply voltage VDD.

{Operation of Data Driver Section 60A}

Figure 10A:
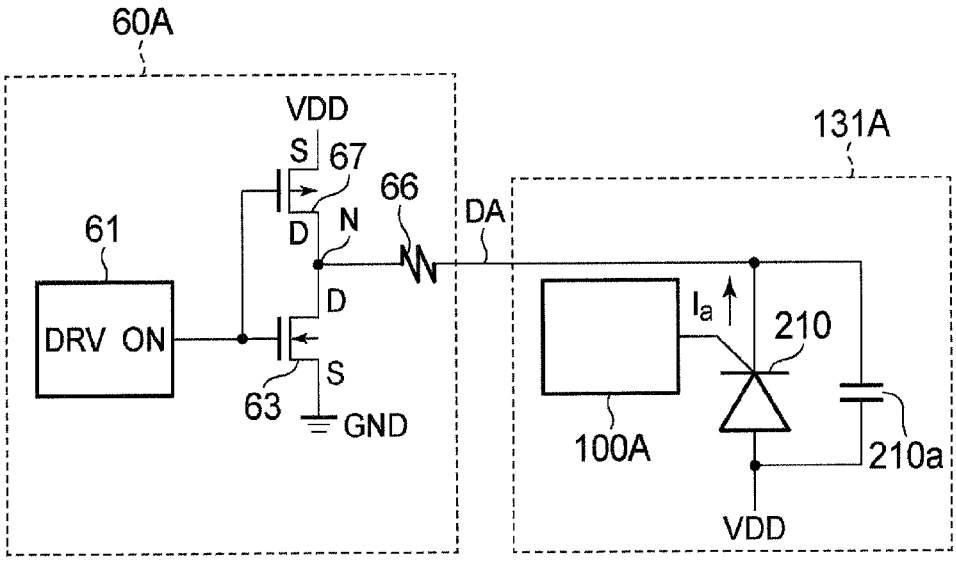
FIG. 10A is a schematic diagram of the data driver section according to the comparative example.
Figure 10B:
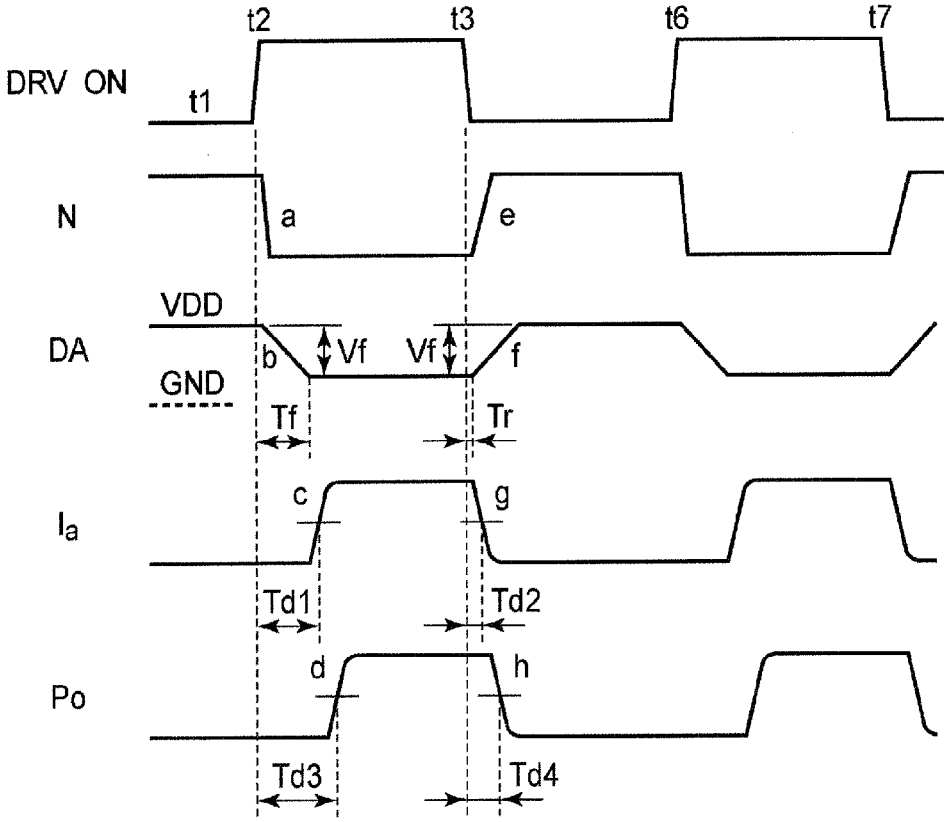
FIG. 10B illustrates the waveform of various signals.

FIG. 10A is a schematic diagram of the data driver section 60A according to the comparative example and FIG. 10B illustrates the waveform of various signals.

Referring to FIG. 10A, the data terminal DA is connected to a print head 131A (comparative example), which is shown in a simplified equivalent form for explanation.

The print head 131A includes the light emitting thyristor 210 whose gate is driven by the scanning circuit 100A. The light emitting thyristor 210 shown in FIG. 10A represents a plurality of light emitting thyristors 210-1 to 210-n connected in parallel with one another. A capacitor 210*a* is connected across the anode and cathode of the light emitting thyristor 210. The capacitor 210*a* is a lumped model of parasitic capacitances that actually exist across the anode and cathode of light emitting thyristors 210-1 to 210-n. The lumped model is a sum of parasitic capacitance, Cj, of emitting thyristors 210-1 to 210-n of static capacitance.

The parasitic capacitance of each light emitting thyristor is rather small but the resultant capacitance Cj of all the parasitic capacitances is not negligibly small: about 192 times that of a signal light emitting thyristor since 192 light emitting thyristors are connected together.

The light emitting thyristor 210 shown in FIG. 10A is a lumped model of a plurality of light emitting thyristors 210-1 and 210-n. This light emitting thyristor 210 has an anode connected to the supply voltage VDD and a cathode connected to the data terminal DA of the data driver section 60A. The capacitor 210*a* is connected between the anode and cathode of the lumped model of the light emitting thyristors 210.

FIG. 10B illustrates the waveform of the ON/OFF command signal DRVON, potential on the node N, potential on the data terminal DA, anode current Ia through the light emitting thyristor 210, and light power Po. The drawbacks due to the parasitic capacitance Cj across the anode-cathode junction of the light emitting thyristors 210-1 to 210-n will be described.

At time t1 shown in FIG. 10B, the ON/OFF command signal DRVON is at the Low level, which is then inverted by the CMOS inverter to become the High level (substantially VDD). Thus, the potential on the data terminal DA is also substantially equal to the supply voltage VDD, and serves as the cathode potential of the light emitting thyristor 210. As a result, the light emitting thyristor 210 turns off. The dotted line in the waveform of the potential on the data terminal DA denotes the ground GND.

At time t2, the ON/OFF command signal DRVON goes high, causing the waveform on the node N to go low (Low level) as depicted at "a," and hence the waveform on the data terminal DA to go low as depicted at "b."

As described above, the capacitor 210*a* is connected between the data terminal DA and the ground GND and the capacitance Cj of the capacitor 210*a* is 192 times that of a single light emitting thyristor 210 if 192 light emitting thyristors are used. As a result, neglecting the ON resistance of the NMOS transistor 63, the fall time Tf of the waveform is proportional to the product of the resistance RO of the resistor 66 and the capacitance Cj of the capacitor 210*a* as follows:

$$Tf \propto RO \times Cj$$

As described above, the capacitance Cj of the capacitor 210*a* is a resultant capacitance of the parasitic capacitance of the light emitting thyristors 210-1 to 210-n, and is significantly large. The resistor 6 having resistance RO serves as a current limiting resistor that sets the current Ia flowing through the light emitting thyristor 210, and therefore cannot be selected at will and cannot be small. As a result, the fall time Tf will necessarily be long.

As shown in FIG. 10B, if the waveform on the data terminal DA falls by voltage Von (ON voltage of the light emitting thyristor 210) from the supply voltage VDD, the anode-cathode voltage of the light emitting thyristor 210 becomes equal to Von. At this moment, the light emitting thyristors 210 turns on so that the anode current Ia of the light emitting thyristor 210 flows and the waveform of the anode current Ia rises as depicted at "c," the rise time of the anode current Ia being Td1.

The anode current Ia causes the light emitting thyristor 210 to emit light so that the light power Po rises as depicted at "d".

At time t3, the waveform of the ON/OFF command signal DRVON falls, causing the waveform on the node N to rise as depicted at "e" so that the waveform on the data terminal DA rises as depicted at "f." The ON/OFF command signal DRVON falls with a rise time Tr, and then the waveform on the data terminal DA rises above a potential lower than the supply voltage VDD minus the ON voltage Von, so that the anode-cathode voltage of the light emitting thyristor 210 becomes lower than the ON voltage Von. Thus, the light emitting thyristor 210 and the anode current Ia falls as depicted at "g." Since the anode current Ia falls, the light emitting thyristor 210 no longer emits light so that the waveform of the light power Po falls as depicted at "h."

Referring 10B, the supply voltage VDD is much higher than the ON voltage Von of the light emitting thyristor 210 and therefore the fall time Tf and rise time Tr are related such that Tf>Tr. Also, the delay time Td1 for the anode current Ia to rise and the delay time Td2 for the anode current Ia to fall are related such that Td1>Td2. Further, the delay time Td3 for the light power Po to rise and the delay time Td4 for the light power Po to fall are related such that Td3>Td4. Thus, the effective duration during which the light emitting thyristor emits light is shorter by Td3−Td4 than t3−t2 which would otherwise be. This implies that the print head 131A illuminates the charged surface of the photoconductive drum 11 with a smaller amount of energy corresponding to the decrease in time described above, which is detrimental to implementation of high speed printing.

{Operation of Data Driver Section}

Figure 11A:
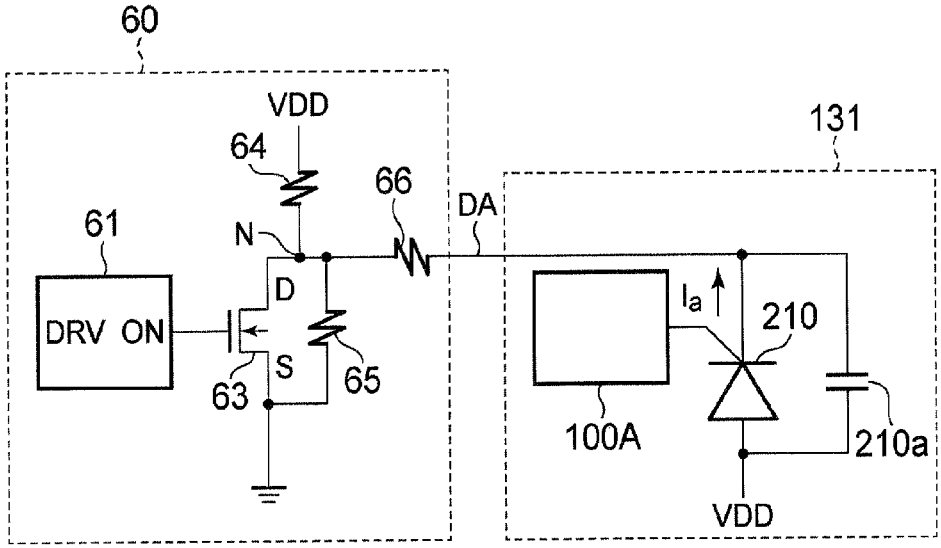
FIG. 11A is a schematic diagram of the data driver section.
Figure 11B:
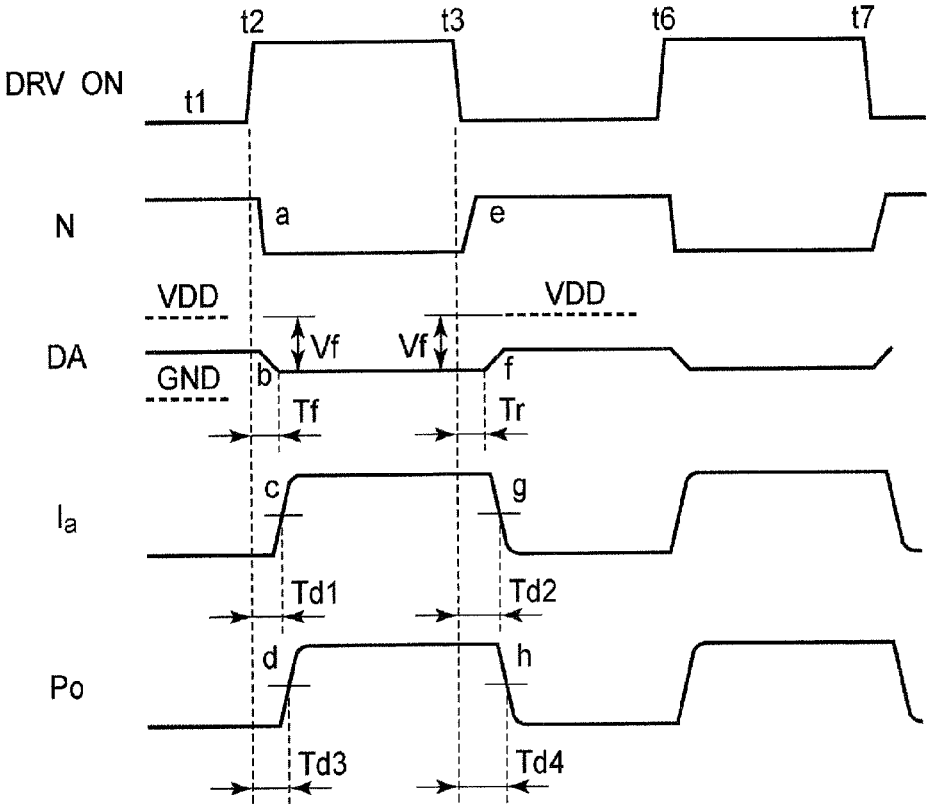
FIG. 11B illustrates the waveforms of various signals.

FIG. 11A is a schematic diagram of the data driver section 60 and FIG. 11B illustrates the waveforms of various signals. Elements similar to those shown in FIGS. 10A and 10B have been given the common reference characters.

Referring to FIG. 11A, the data terminal DA is connected to the print head 131, which is in a simplified equivalent form for explanation.

The print head 131 includes light emitting thyristors whose gates are driven by the scanning circuit 100. The light emitting thyristor 210 shown in FIG. 11A represents one of a plurality of light emitting thyristors 210-1 to 210-n connected in parallel with one another. A capacitor 210*a* (static capacitance Cj) is connected across the anode and cathode of the light emitting thyristor 210. The capacitor 210*a* is a lumped model of parasitic capacitances that actually exist across the anode and cathode of light emitting thyristors 210. The lumped model is a sum of parasitic capacitance, Cj, of emitting thyristors 210-1 to 210-n of static capacitance.

The parasitic capacitance of each light emitting thyristor is rather small but the resultant capacitance of all the parasitic capacitances Cj is not negligibly small: about 192 times that of a signal light emitting thyristor since 192 light emitting thyristors are connected together.

The light emitting thyristor 210 shown in FIG. 11A is a lumped model of a plurality of light emitting thyristors 210-1 and 210-n. This light emitting thyristor 210 has an anode connected to the supply voltage VDD and a cathode connected to the data terminal DA of the data driver section 60. The capacitor 210*a* is connected between the anode and cathode of the lumped model of the light emitting thyristors 210.

Figure 11C:
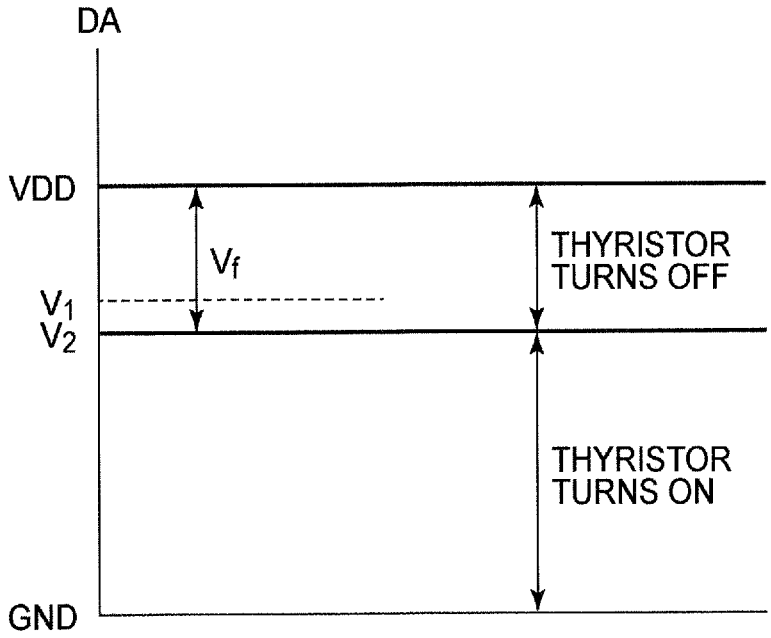

FIG. 11B illustrates the waveform of the ON/OFF command signal DRVON, potential on the node N, potential on the data terminal DA, current Ia through the light emitting thyristor 210, and light power Po. FIG. 11C illustrates the voltage V1 at the node N when the PMOS transistor 63 is off, V2 above which the thyristor turns off and below which the thyristor turns on, and VDD.

At time t1 in FIG. 11B, the ON/OFF command signal DRVON is at the Low level, which is then inverted by the CMOS inverter to become the High level (substantially VDD). Thus, the potential on the node N is substantially equal to the supply voltage VDD divided by the resistor 64 and 65. The voltage at the node N is fed to the cathode of the light emitting thyristor 210 through the resistor 66. Setting the voltage at the node N or the common terminal IN to a voltage V1 slightly higher than the supply voltage VDD minus the threshold voltage Vf of the light emitting thyristor 21, as shown in FIG. 11C, enables the light emitting thyristor to turn off. The voltage V1 is determined as follows:

$$V1 = \frac{R65}{R64 + R65} \times VDD$$

where V1 is the voltage at the node, R65 is the resistance of the resistor 65, and R64 is the resistance of the resistor 64.

At time t2, the ON/OFF command signal DRVON goes high and therefore the NMOS transistor 63 turn on, causing the waveform on the node N to go low (Low level) as depicted at "a," and hence the waveform on the data terminal DA to go low as depicted at "b."

As described above, the capacitor 210*a* is connected between the data terminal DA and the ground GND, and the capacitance Cj of the capacitor 210*a* is 192 times that of a single light emitting thyristor 210 if 192 light emitting thyristors are used. As a result, neglecting the ON resistance of the NMOS 63, the fall time Tf of the waveform is proportional to the product of the resistance RO of the resistor 66 and capacitance Cj of the capacitor 210*a* as follows:

$$Tf \propto RO \times Cj$$

As described previously, the capacitance of the capacitor 210*a* is a resultant capacitance Cj of parasitic capacitances of the light emitting thyristors 210C-1 to 210C-n, and has a very large value.

The resistance RO of the resistor 66 serves as a current limiting resistor that determines the anode current Ia flowing through the light emitting thyristor 210n. Therefore, the resistance RO cannot be selected independently and cannot be small. As a result, the fall time Tf will necessarily be long.

It is to be noted that the High level on the data terminal DA is lower than the supply voltage VDD. Thus, at a fall time Tf after the ON/OFF command signal DRVON goes high, the waveform on the data terminal DA falls by the voltage Von (ON voltage of the light emitting thyristor 210) from the supply voltage VDD as depicted at "b" shown in FIG. 11B, so that the anode-cathode voltage of the light emitting thyristor 210 becomes equal to Von. At this moment, the light emitting thyristor 210 turns on so that the anode current Ia of the light emitting thyristor 210 flows and the waveform of the anode current Ia rises as depicted at "c," the rise time of the anode current Ia being Td1. Since the anode current Ia rises, the light emitting thyristor 210 emits light so that the waveform of the light power Po rises as depicted at "d."

Comparing FIG. 11B and FIG. 10B reveals that the data drive section 60 of the first embodiment provides a shorter fall time Tf of the waveform on the data terminal DA. Also, the anode current Ia to rise with the shorter delay time Td1.

At time t3, the ON/OFF command signal DRVON falls and the NMOS transistor 63 turns off so that the waveform at the node N on the drain side rises as depicted at "e." Thus, the waveform on the data terminal DA goes high through the resistor 66 as depicted at "f". The ON/OFF command signal DRVON falls with a rise time Tr, then the waveform on the data terminal DA rises above a potential lower than the supply voltage VDD minus the ON voltage Von, so that the anode-cathode voltage of the light emitting thyristor 210 becomes lower than the ON voltage Von. Thus, the light emitting thyristor 210 turns off and the anode current Ia falls as depicted at "g." Since the anode current Ia falls, the light emitting thyristor 210 no longer emits light so that the waveform of the light power Po falls as depicted at "h."

Referring 11B, the High level on the waveform of the data terminal DA is slightly higher than the supply voltage VDD minus the ON voltage Von of the light emitting thyristor 210, so that the rise time Tr and fall time Tf are related such that Tf ≈Tr. Also, the anode current Ia rises with the delay time Td1 and falls with the delay time Td2. The delay times Td1 and Td2 are related such that Td1≈Td2. Further, the light power Po rises with the delay time Td3 and falls with the delay time Td4. The delay times Td3 and Td4 are related such that Td3 ≈Td4.

Thus, the effective duration during which the light emitting thyristor emits light can be substantially equal to the difference between time t3 and time t2. This implies that the print head 131 illuminates the charged surface of the photoconductive drum 11 without loosing a significant portion of exposure energy and poor printing result can be avoided.

Modification to First Embodiment

Figure 12:
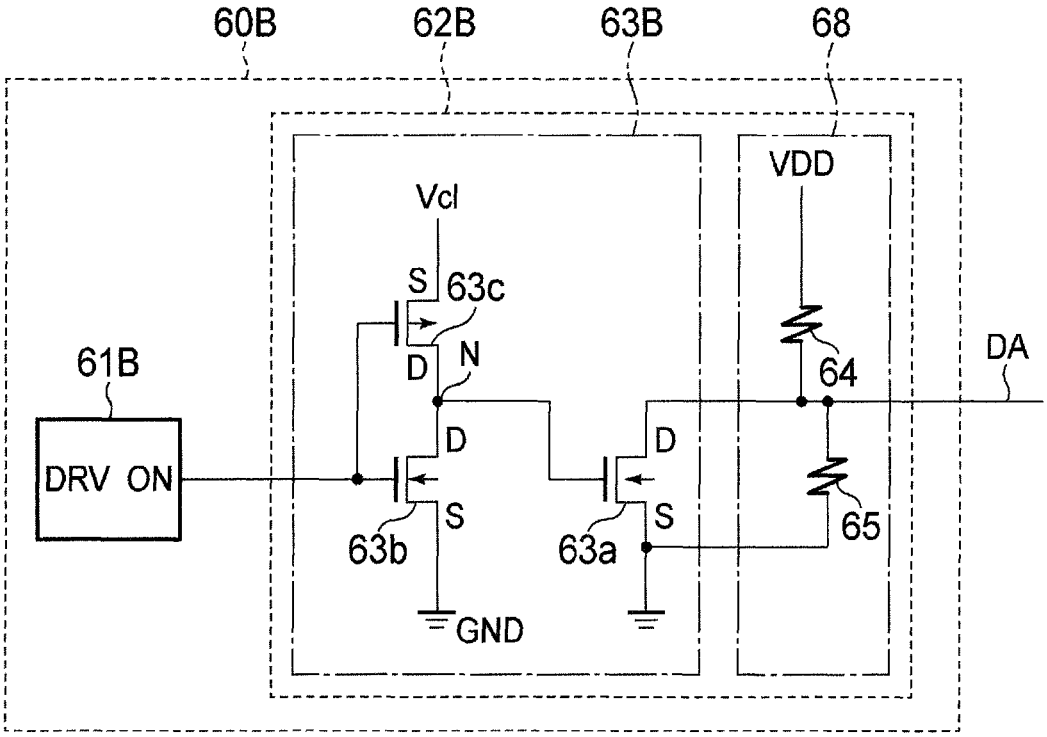
FIG. 12 is a schematic diagram illustrating a modification to the data driver section according to the first embodiment.

FIG. 12 is a schematic diagram illustrating a modification to the data driver section 60 according to the first embodiment. Elements similar to those shown in FIG. 1 have been given the common reference characters.

A data driver section 60B according the modification differs from the data driver section 60 in that a data control circuit 61B and a data driver circuit 62B are employed.

The data control circuit 61B outputs an ON/OFF command signal DRVON-N which is implemented using negative logic. The data driver circuit 62B includes a driver circuit 63B and a voltage divider 68 connected to the output of the driver circuit 63B.

The driver circuit 63B includes a CMOS inverter formed of an NMOS transistor 63*a*, an NMOS transistor 63*b*, and a PMOS transistor 63*c*, and serves as a constant current source. The output of the data control circuit 61B is connected to the gate of the NMOS transistor 63 and PMOS transistor 63*c*. The PMOS transistor 63*c* has its source connected to a control voltage Vc1 generated by a control voltage generating circuit (not shown), and its drain connected to the ground GND through the NMOS transistor 63*b*. The NMOS transistor 63*a* has its gate connected to the drain of the PMOS transistor 63*c* and NMOS transistor 63*b*, its source connected to the ground GND, and its drain connected to the voltage divider 68.

The voltage divider 68 includes resistors 64 and 65 which are connected in series between the supply voltage VDD and the ground GND. The junction of the resistors 64 and 65 is connected to the data terminal DA.

The data driver section 60B operates as follows: If the ON/OFF command signal DRVON-N is the High level, the PMOS transistor 63*c* goes off and the NMOS transistor 63*b* goes on, causing the gate potential of the NMOS transistor 63*a* to go low. This causes the NMOS transistor 63*a* to turn off, so that the data terminal DA goes high. The High level on the data terminal DA is the supply voltage VDD divided by the resistors 64 and 65. When the potential on the data terminal DA is at the High level, the anode-cathode voltage of the light emitting thyristors 210-1 to 210-n shown in FIG. 1 becomes lower than the ON voltage of the light emitting thyristors 210-1 to 210-n, so that the light emitting thyristors 210-1 to 210-n turn off.

If the ON/OFF command signal DRVON-N is at the Low level, the PMOS transistor 63*c* goes on and the NMOS transistor 63*b* goes off, causing the gate potential of the NMOS transistor 63*b* to go high so that the gate potential is substantially equal to the control voltage Vc1. This causes the NMOS 63*a* to turn on. Selecting a reasonable value of the control voltage Vc1 allows the NMOS transistor 63*a* to operate in its saturation region so that the drain current of the NMOS transistor 63*a* is substantially constant. This makes the driver circuit 63B behave as a circuit similar to a constant current source.

The light output characteristic of the light emitting thyristor 210 shown in FIG. 6 is mainly determined by the anode current, and therefore it is desirable that the data driver circuit 62B has a constant current characteristic. However, since the resultant capacitance of the capacitance, Cj, of all light emitting thyristors is significantly large, if any one of such light emitting thyristors is to be driven by a constant current source, the waveform of the output voltage of the driver circuit 62B changes slowly, especially when the drive current is relatively small.

Therefore, the modification includes the voltage divider 68 formed of the resistors 64 and 65, so that the High level on the data terminal DA is set to a voltage just above the threshold potential below which the light emitting thyristor turn on.

While the voltage divider 68 is also effective for the data driver circuit 62 shown in FIG. 6, the voltage divider 68 is particularly effective when used in the data driver circuit 62B which serves as a constant current source. The voltage divider 68 is particularly useful if the light emitting thyristor 210 has a high light output efficiency, i.e., capable of emitting a large amount of light at low drive current.

{Effects of First Embodiment}

The first embodiment and modification provide the following effects.

(1) The light emitting thyristors 210-1 to 210-n are driven by the data driver section 60 or 60B that employs the voltage dividing resistors 64 and 65. The potential on the data terminal DA is set equal to the supply voltage VDD divided by the resistors 64 and 65, thereby shortening the time required for the light emitting thyristors to turn on that would otherwise be significantly long due to a large resultant parasitic capacitance across the anode and cathode of the light emitting thyristors. This configuration eliminates loss of exposure energy when the print head 131 illuminates the charged surface of the photoconductive drum 11, and therefore solves the problem of poor printing operation.

(2) The use of the print head 131 of the aforementioned configuration provides a high quality image forming apparatus 1 that is excellent in space utilization efficiency and light output efficiency. The print head 131 is particularly useful for a full color image forming apparatus that uses more than one print heads 131.

Second Embodiment

A print head 132 according to a second embodiment differs from the print head 131 in that scanning thyristors 110C of a negative gate three-terminal thyristor and light emitting thyristors 210C of a negative gate three-terminal thyristor are employed. A description will be given only of a portion different from the first embodiment.

Print Head

Figure 13:
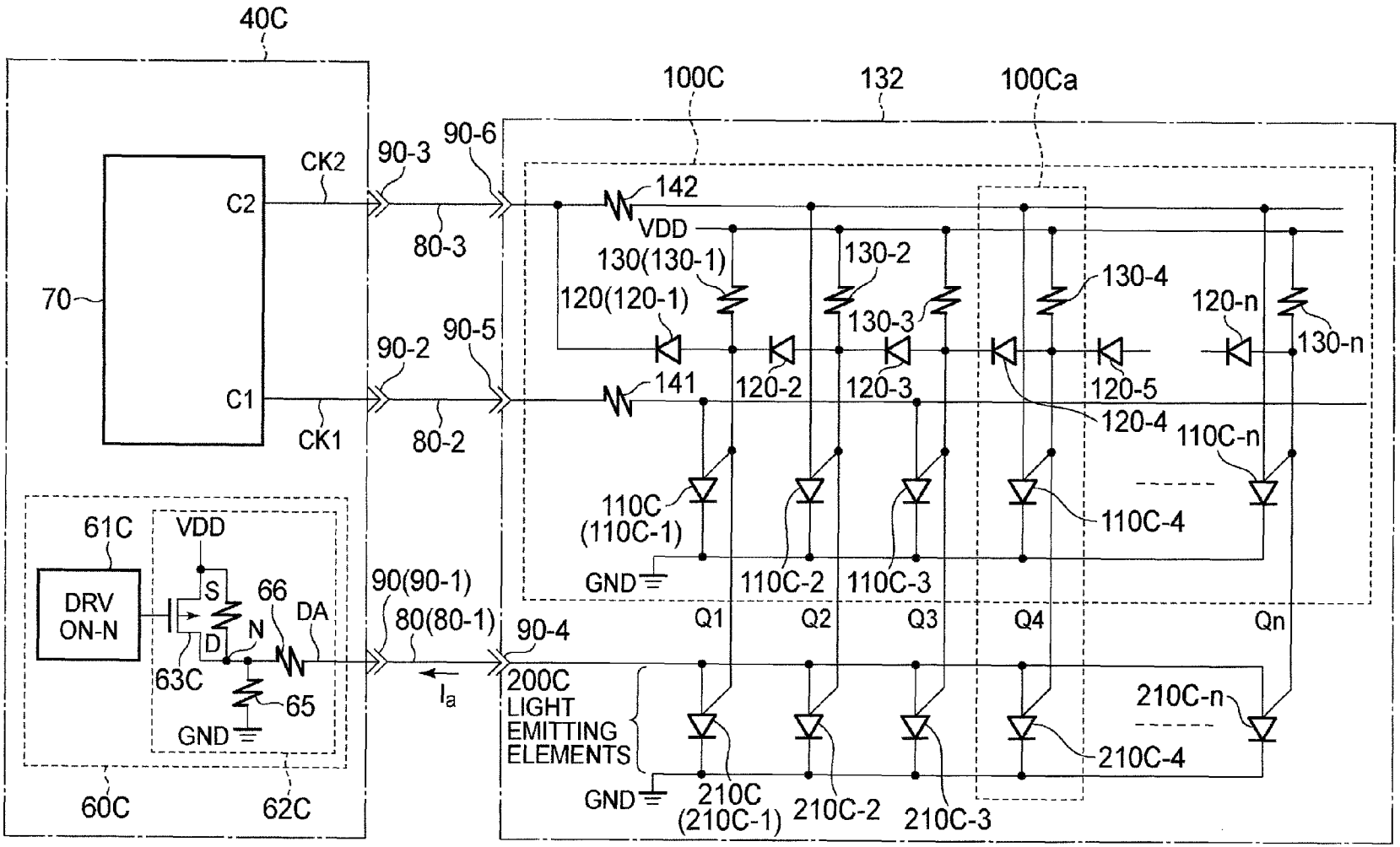
FIG. 13 is a schematic diagram illustrating the configuration of the print head according to a second embodiment.

FIG. 13 is a schematic diagram illustrating the configuration of the print head 132. Elements common to those of the first embodiment have been given the common reference characters.

The print head 132 includes a scanning circuit 100C and light emitting elements 200C. These sections are connected to a printing controller 40C via cables 80-1 to 80-3 and connectors 90-1 to 90-6. The scanning circuit 100C and light emitting elements 200C operate on the supply voltage VDD (e.g., 3.3V).

The printing controller 40C includes a data driver section 60C that is different from the data driver section 60 of the first embodiment and a clock driver circuit 70 that is substantially the same as the clock driver circuit 70 of the first embodiment. The data driver section 60C operates on the supply voltage VDD, and drives the logic level (i.e., High and Low) of a common terminal IN of the light emitting elements 200C. The clock driver circuit 70 operates on the supply voltage VDD, and generates a two-phase clock signal having a first clock C1 and a second clock C2 for driving the scanning circuit 100C.

The driver for driving the light emitting elements 200C includes the scanning circuit 100C, data driver section 60C, and clock driver circuit 70. FIG. 13 illustrates an exemplary configuration in which the data driver section 60C and the clock driver circuit 70 are in the printing controller 40C. Alternatively, the data driver section 60C and the clock driver circuit 70 may be disposed within the print head 132.

The light emitting elements 200C include a plurality of stages of N-gate light emitting thyristors 210C-1 to 210C-n, which are three-terminal light emitting elements. Each light emitting thyristor 210C has a cathode connected to the ground GND, an anode connected to a connector 90-4 via the common terminal IN through which an anode current Ia flows, and a gate connected to one of the output terminals Q1 to Qn. If the print head 132 is to print on A4 size paper at a resolution of 600 dots per inch (600 dpi), the print head 132 has 4992 light emitting thyristors aligned in a straight line.

The scanning circuit 100C is driven by a two-phase clock signal, i.e., the first clock C1 and second clock C2 supplied from the clock driver circuit 70, thereby controlling the trigger current to turn on and off the light emitting elements. The first clock C1 is supplied via the first clock terminal CK1, connector 90-2, cable 80-2, and connector 90-5. The second clock C2 is supplied via the second clock terminal CK2, connector 90-3, cable 80-3, and connector 90-6. The scanning circuit 100 includes a plurality of stages of 3-terminal thyristors (e.g., N-gate scanning thyristor) 110-1 to 110-n (e.g., n=4992), a plurality of diodes 120-1 to 120n, and a plurality of resistors 130-1 to 130-n. The scanning circuit 100 is a self-scanning circuit.

Each scanning thyristor 110C has a cathode connected to the ground GND, an anode, and a gate connected to the gate of the light emitting thyristor of a corresponding stage through a corresponding one of the output terminals Q1 to Qn and connected to the supply voltage VDD through the resistor 130.

The anodes of odd-numbered scanning thyristors 110C-1, 110C-3, 110C-5, . . . , 110C-(n−1) are connected to the connector 90-5 through a resistor 141. The anodes of even-numbered scanning thyristors 110C-2, 110C-4, 110C-6, . . . 110C-n are connected to the connector 90-6 through a resistor 142.

The first stage scanning thyristor 110C-1 has its gate connected to the connector 90-6 through the forward diode 120-1. Adjacent scanning thyristors are connected to each other through a diode 120 such that the cathode of the diode 120 is connected to the gate of a preceding one of the adjacent light thyristors and the anode of the diode 120 is connected to a following one of the adjacent scanning thyristors. Just as in the first embodiment, the diode 120 determines the direction in which the scanning thyristors 110C-1 to 110C-n are turned on, for example, rightward in FIG. 13.

The scanning thyristors 110C and light emitting thyristors 210C are configured to have an identical structure of semiconductor layers and operate in substantially the same manner. The light emitting thyristors 210C are designed to emit light while the scanning thyristors 110C do not need to emit light. Therefore, the scanning thyristors 110C are covered with, for example, a metal film which is not transparent to light.

The circuit 100Ca shown by dotted lines is a minimum unit which is a combination of the scanning circuit 100C and light emitting thyristor 210C. Therefore, it can be thought that the print head 13 includes a total of n stages of the minimum unit cascaded in order as shown in FIG. 13.

The scanning thyristors 110C-1 to 110C-n are selectively turned on in response to the two-phase clock signal, i.e., first clock C1 and second clock C2 received via the first clock terminal CK1 and the second clock terminal CK2, respectively. The ON state of the scanning thyristor 110C is transmitted to a corresponding light emitting thyristor 210C that should be turned on. Also, the ON state of the scanning thyristor 110C is transmitted to the next adjacent scanning thyristor 110C on the first clock C1 and second clock C2, so that the scanning thyristors 110C serve as a shift register as a whole.

The resistors 130-1 to 130-n are used for ensuring the operation of the scanning circuit 100C, and may be omitted if the scanning thyristors 110C-1 to 110C-n can operate reliably without the resistors 130-1 to 130-n.

The data driver section 60C includes a data control circuit 61C that generates an ON/OFF command signal DRVON-N implemented using negative logic for supplying the anode current Ia as drive data driving the light emitting thyristors 210C in a time division manner. FIG. 13 shows only one data driver section 60C for simplicity.

The data driver section 60C includes a data control circuit 61C that generates the negative logic ON/OFF command signal DRVON-N and a data driver circuit 62C that drives the ON/OFF command signal DRVON-N. The data drive circuit 62C includes a PMOS transistor 63C and resistors 64 and 65. The PMOS transistor 63C has a gate to which the ON/OFF command signal DRVON-N is fed, a drain connected to the node N, and a source connected to the supply voltage VDD. The resistors 64 and 65 are connected between the supply voltage VDD and the ground GND. A resistor 66 is connected between the node N and the data terminal DA.

For example, if the ON/OFF command signal DRVON-N outputted from the data control circuit 61C is at the High level, the PMOS transistor 63C turns off, so that the resistor 65 pulls down the potential at the data terminal DA to the Low level. The Low level at the data terminal DA is fed to the anode of the light emitting thyristors 210C through the data terminal DA and common terminal IN, causing the anode-cathode voltage of the light emitting thyristor 210C to decrease so that none of the light emitting thyristors 210C-1 to 210C-n emits light.

Conversely, if the ON/OFF command signal DRVON-N is at the Low level, the PMOS transistor 63C turns on, causing the potential at the node N to go high, near the supply voltage VDD. Thus, the High level is fed to the anode of the light emitting thyristor 210C-1 to 210C-n through the data terminal DA and the common terminal IN, so that a voltage nearly equal to the supply voltage is applied across the anode and cathode of the light emitting thyristors 210C-1 to 210C-n. If a triggering current flows through the gate of a selected one of the light emitting thyristors 210C-1 to 210C-n, the selected light emitting thyristor turns on. As a result, the potential of the data terminal DA becomes substantially equal to the ON voltage of the light emitting thyristors 210C-1 to 210C-n.

{Light Emitting Thyristor}

Figure 14A:
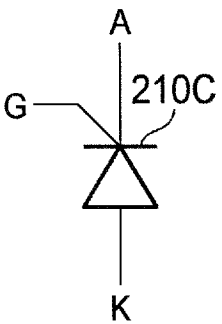
FIG. 14A shows the circuit symbol of a light emitting thyristor having three terminals according to the second embodiment.
Figure 14B:
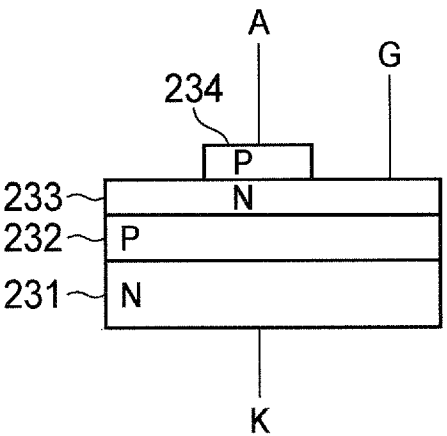
FIG. 14B is a cross-sectional view of the light emitting thyristor shown in FIG. 14A.
Figure 14C:
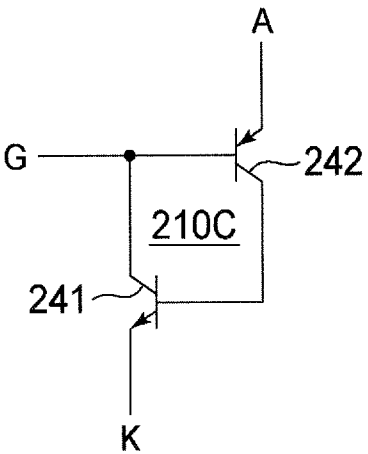
FIG. 14C illustrates an electrical equivalent circuit of the light emitting thyristor shown in FIG. 14B.

FIGS. 14A-14C illustrate the configuration of the light emitting thyristor 210C shown in FIG. 13.

FIG. 14A shows the circuit symbol of the light emitting thyristor 210C having three terminals: anode A, cathode K, and gate G.

FIG. 14B is a cross-sectional view of the light emitting thyristor 210C. The light emitting thyristor 210C may be fabricated by epitaxially growing a crystal structure on an N type GaAs wafer 231 by conventional metal organic chemical vapor deposition (MO-CVD).

The following layers are formed on the N type GaAs wafer 231: a P-type layer 232 that contains a P-type impurity, an N-type layer 233 that contains an N-type impurity, and a P-type layer 234 that contains a P-type impurity in this order. In this manner, a PNPN structure or a four-layer structure of AlGaAs is fabricated on the N type GaAs wafer 231. Grooves (not shown) are then formed in the wafer to isolate individual devices by a known etching technique.

When etching is performed, a part of the P-type layer 233 is etched to expose. A metal wiring is formed on the exposed region to form a gate G. The uppermost P-type layer 234 is partially exposed and a metal wiring is formed on the exposed region to form an anode A. A metal wiring is formed on a side of the P-type layer 231 opposite the P-type layer 232, thereby forming a cathode K.

The scanning thyristors 110C shown in FIG. 13 have the same internal structure as the light emitting thyristors 210C.

FIG. 14C illustrates an electrical equivalent circuit of the light emitting thyristor 210C shown in FIG. 14B. The light emitting thyristor 210C is constituted of an NPN transistor 241 and a PNP transistor 242. The emitter of the NPN transistor 241 corresponds to the cathode K of the light emitting thyristors 210C, and the base of the PNP transistor 241 corresponds to the gate G. The emitter of the PNP transistor 242 corresponds to the anode A. The collector of the NPN transistor 241 is connected to the base of the PNP transistor 242. The base of the NPN transistor 241 is connected to the collector of the PNP transistor 242.

The light emitting thyristor 214 shown in FIGS. 14A-14C has an AlGaAs layer formed on the GaAs wafer 231. The thyristor 210C is not limited to this configuration. The thyristor 210C may have a layer of GaP, GaAsP, AlGaInP or InGaAsP formed on the GaAs wafer. Alternatively, the thyristor 210C may have a GaN layer, an AlGaN layer, or an InGaN layer formed on a silicon substrate or a sapphire substrate.

{Brief Description of Operation of Print Head}

Referring back to FIG. 13, if the first clock C1 goes high (High level), and the second clock C2 goes low, the first clock C1 is fed to the anode of the scanning thyristor 110C-1 through the connector 90-2, cable 80-2, connector 90-5, and resistor 141. The second clock C2 is fed to the gate of the scanning thyristor 110C-1 through the connector 90-3, cable 80-3, connector 90-6, and diode 120-1. Thus, a triggering current flows through a gate-anode current path, causing the scanning thyristor 110C-1 to turn on. Thus, the scanning circuit 100C initiates its shift operation so that the gate of the succeeding stages of scanning thyristors 110C-2 to 110C-n goes high (High level), to turn on the scanning thyristors in sequence.

It is to be noted that the gate of a scanning thyristor (e.g., 110C-2) that has turned on is at the Low level, i.e., at substantially the same voltage as the ground GND. The light emitting thyristor (e.g., 210C-2) corresponding to the scanning thyristor has its cathode connected to the ground GND. If the anode of the light emitting thyristor (e.g., 210C-2) goes high (High level), voltage is applied across the cathode-anode junction of the light emitting thyristor 210C-2.

Since the gate of the scanning thyristor 110C-2 is connected to the gate of the light emitting thyristor 210C-2, these two gates are at the same potential. If the gate of the light emitting thyristor 210C-2 is selected to be energized and goes low, the trigger current flows from anode to gate of the light emitting thyristor 210C-2 causing the light emitting thyristor 210C-2 to turn on. The current flowing through the anode of the light emitting thyristor 210C-2 is an anode current Ia that flows from the data terminal DA. Thus, the light emitting thyristor 210C-2 emits light in accordance with the anode current Ia.

{Detailed Operation of Print Head}

Figure 15:
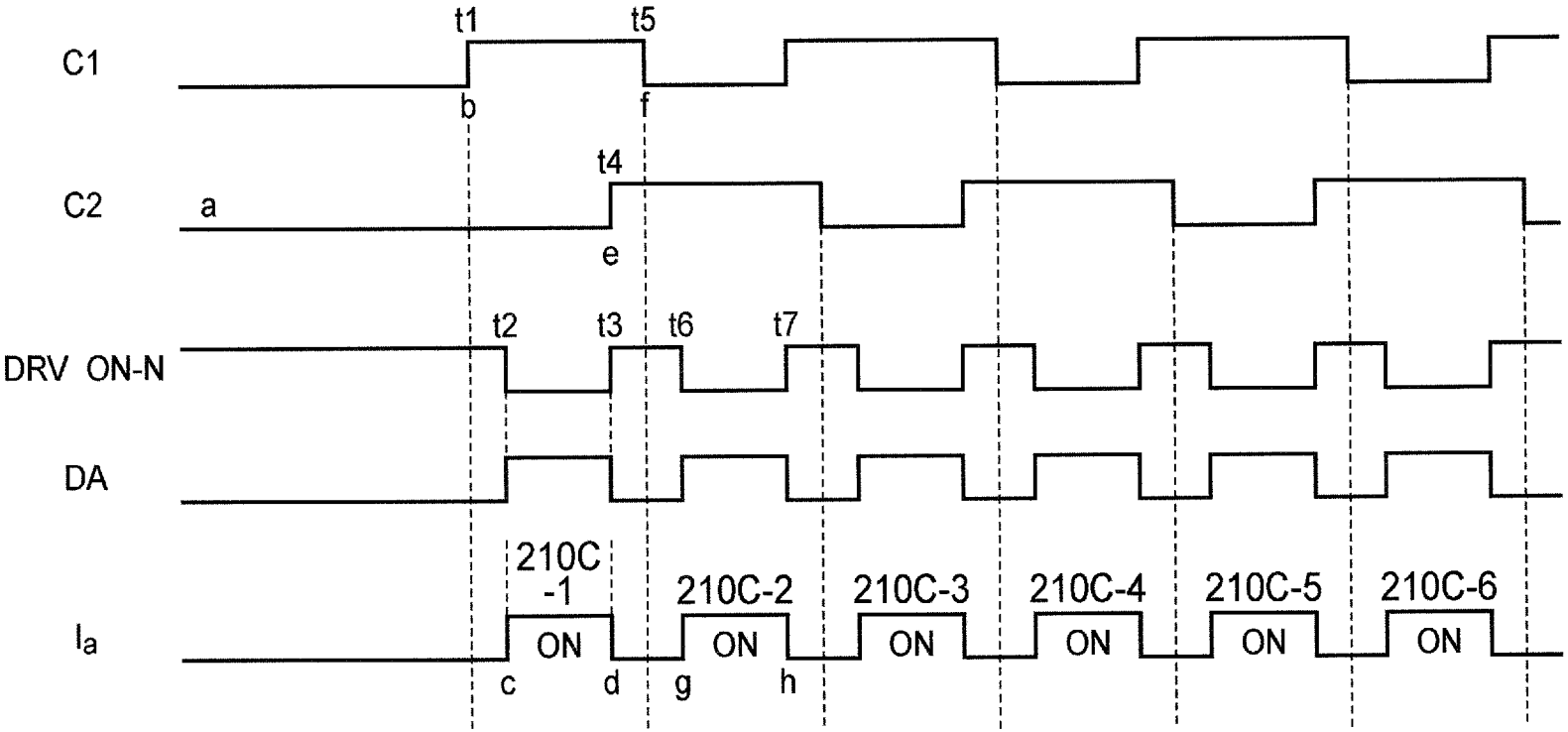
FIG. 15 is a timing chart illustrating the details of the operation of the print head shown in FIG. 13.

FIG. 15 is a timing chart illustrating the details of the operation of the print head 132 shown in FIG. 13. Elements similar to those of the first embodiment have been given the common reference characters.

FIG. 15 illustrates the waveform of respective signals when the light emitting thyristors 210C-1 to 210C-n are turned on alternately one at a time in a single scanning line. FIG. 15 shows only six thyristors, i.e., the light emitting thyristors 210C-1 to 210C-6 of the light emitting thyristors 210C-1 to 210C-n for simplicity.

The scanning circuit 100C using scanning thyristors 110C operates on the two-phase clock signal, i.e., first clock C1 and second clock C2. The first clock C1 and second clock C2 are generated by the clock driver circuit 70 and outputted from the first and second clock terminals CK1 and CK2, respectively.

Before time t1 shown in FIG. 15, the first clock C1 and second clock C2 are at the low level, and are outputted from the first and second clock terminals CK1 and CK2, respectively. The low level first clock C1 is fed to the anodes of odd-numbered scanning thyristors 110C-1, 110C-3, 110C-5, . . . 110C-(n−1) through the resistor 141, and the low level second clock C2 is fed to the anodes of even-numbered scanning thyristors 110C-2, 110C-4, 110C-6, 110C-n through the resistor 142. Therefore, their anode currents cannot flow, causing the odd-numbered scanning thyristors 110C-1, 110C-3, 110C-5, . . . 110C-(n−1) and even-numbered scanning thyristors 110C-2, 110C-4, 110C-6, . . . , 110C-n to turn off.

Before time t1 shown in FIG. 15, the ON/OFF command signal DRVON-N, outputted from the data control circuit 61C, is the High level. If the PMOS transistor 63C is in the OFF state, the data terminal DA is at the Low level. The Low level at the data terminal DA is fed to the anodes of the respective light emitting thyristors 210C-1 to 210C-n through the connector 90-1, cable 80-1, connector 90-4, and common terminal IN. Thus, the anode-cathode voltage decreases, causing the anode current Ia to become zero, so that none of the light emitting thyristors 210C-1 to 210C-n emits light. A description will be given of the process for turning on the scanning thyristor 110C-1 in the first stage scanning circuit and the scanning thyristor 110C-2 in the second stage scanning circuit, respectively.

Phase I: Turning-on of Thyristor 110-1

At time t1 shown in FIG. 15, the first clock C1 goes high as depicted at "b" and the second clock C2 is at the Low level. The low level second clock C2 is fed to the gate of the scanning thyristor 110-1, causing the trigger current to flow through the anode-gate junction of the scanning thyristor 110C-1 and the diode 120-1 to the clock terminal CK2. Thus, the scanning thyristor 110C-1 turns on.

At time t2, the ON/OFF command signal DRVON-N goes low and is fed to the data driver circuit 62C. Thus, the PMOS transistor 63C turns on so that the data terminal DA goes high (High level) through the resistor 66. Therefore, a voltage substantially equal to the supply voltage VDD is applied across the anode-cathode junction of the light emitting thyristor 210C-1. At this time, the scanning thyristor 110C-1 has turned on, the gate potential of the scanning thyristor 110C-1 and the light emitting thyristor 210C-1 is substantially equal to the ground GND.

The High level on the data terminal DA applies voltage across the anode-gate junction of the light emitting thyristor 210C-1 causing gate current to flow therethrough. Thus, the light emitting thyristor 210C-1 turns on. As a result, an anode current Ia flows through the anode of the light emitting thyristor 210C-1 as depicted at "c" so that the light emitting thyristor 210C-1 emits light in accordance with the anode current Ia.

At time t3, the ON/OFF command signal DRVON-N goes high. This high level is fed to the data driver circuit 62C, causing the PMOS transistor 63C to go off. Then, the potential of the data terminal DA goes low, so that the anode-cathode voltage of the light emitting thyristor 210C-1 decreases. This causes the anode current path to shut off so that the light emitting thyristor 210C-1 turns off and therefore the anode current Ia becomes substantially zero as depicted at "d."

The light emitting thyristor 210C-1 emits light to form an electrostatic latent image on the photoconductive drum 11 shown in FIG. 2. The exposing energy is determined by the exposing time (i.e., time t3 to time t2) times the light power produced by the anode current Ia. The light power may vary due to variations in manufacturing process, but the exposing time for individual thyristors may be adjusted to compensate for the variations of light power. If the light emitting thyristor 210C is not to be turned on, the ON/OFF command signal DRVON-N can be maintained high for a period of time, from time t2 to time t3. In this manner, the ON/OFF command signal DRVON-N can drive the light emitting thyristors 210C to emit or not to emit light.

{Turning on of Self-Scanning Thyristor 110-2}

At time t4, the second clock C2 goes high as depicted at "e." Immediately before time t4, the scanning thyristor 110C-1 is in the ON state and the gate of the scanning thyristor 110C-1 is at the Low level. This low level the gate of the scanning thyristor 110C-1 is fed to the gate of the scanning thyristor 110C-2 through the diode 120-2, causing gate current to flow through the anode-gate junction of the scanning thyristor 110C-2 and then forward diode 120-2 into the gate of the scanning thyristor 110C-1. As a result, the scanning thyristor 110C-2 turns on.

At time t5, the first clock C1 outputted from the first clock terminal CK1 goes low as depicted at "f," thereby shutting off the current path of the anode current Ia to turn off the scanning thyristor 110C-1.

At time t6, the ON/OFF command signal DRVON goes low, causing the potential on the data terminal DA to go high. When the potential on the data terminal DA becomes high, a voltage substantially equal to the supply voltage VDD is applied across the anode-cathode junction of the light emitting thyristor 210C-2. At time t6, the scanning thyristor 110C-2 is in its ON state and the scanning thyristor 110C-1 is in its OFF state. The scanning thyristor 110C-2 and the light emitting thyristor 210C-2 have their gate electrode connected together, so that the scanning thyristor 110C-2 and light emitting thyristor 210C-2 turn on and off simultaneously. Thus, the anode current Ia flows through the cathode of the light emitting thyristor 210C-2 as depicted at "g," causing the light emitting thyristor 210C-2 to emit light in accordance with the anode current Ia.

At time t7, the ON/OFF command signal DRVON-N again goes high and the data terminal DA goes low, which shuts off the current path for the anode current of the light emitting thyristor 210C-2 causing the anode current Ia to decrease to substantially zero as depicted at "h."

Likewise, the scanning thyristors 110C-2 to 110C-n can be turned on in sequence on the first and second clocks C1 and C2. As described above, the ON/OFF command signal DRVON-N having the Low level is applied to scanning thyristors 110C-1 to 110C-n in sequence, so that the light emitting thyristors 210C-1 to 210C-n corresponding to the scanning thyristors 110C-1 to 110C-n, respectively, are selectively caused to emit light.

{Operation of Data Driver Section}

Figure 16A:
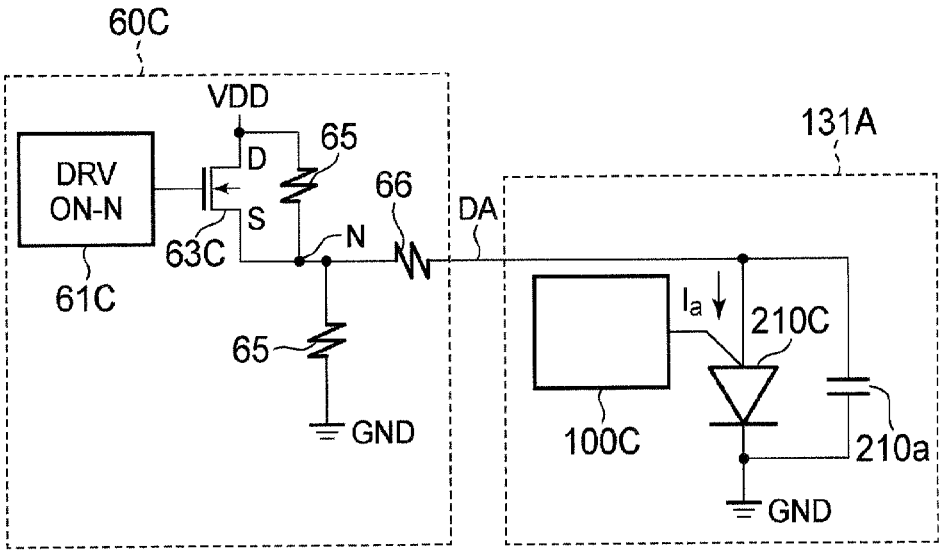
FIG. 16A is a schematic diagram of a data driver section according to the second embodiment.
Figure 16B:
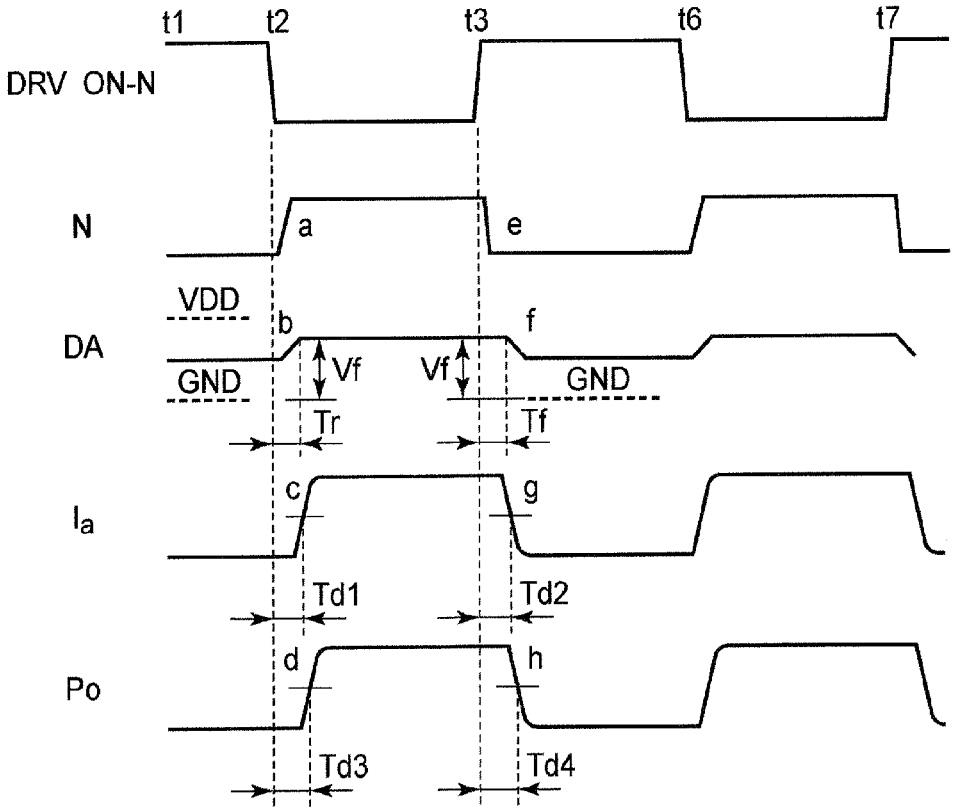
FIG. 16B illustrates the waveform of various signals in the second embodiment.
Figure 16C:
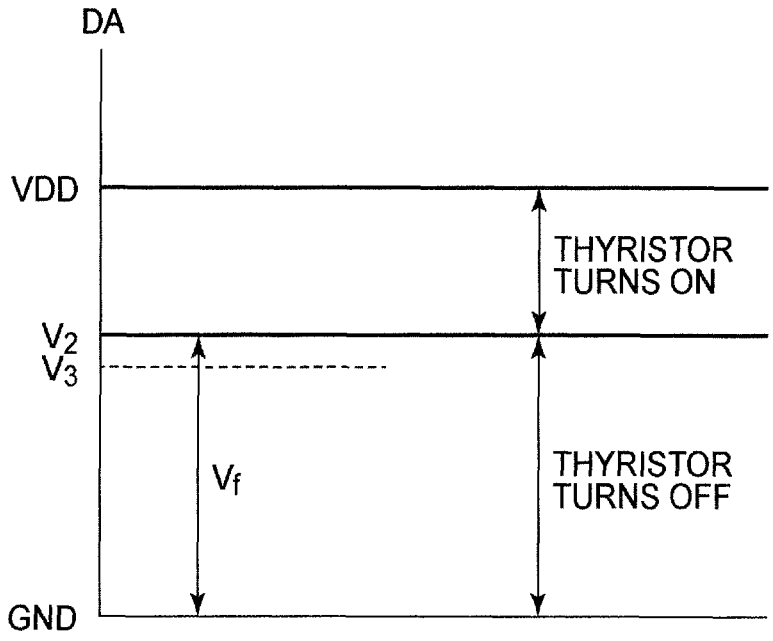
FIG. 16C illustrates the relation among VDD and a voltage above which the thyristor turns on and below which the thyristor turns off.

FIG. 16A is a schematic diagram of the data driver section 60C and FIG. 16B illustrates the waveform of various signals. Elements shown in FIGS. 16A and 16B similar to those show in FIGS. 11A and 11B have been given the common reference characters. FIG. 16C illustrates the voltage V3 at the node N when the PMOS transistor 63C is off, V2 above which the thyristor turns on and below which the thyristor turns off, and VDD.

Referring to FIG. 16A, the data terminal DA is connected to the print head 132, which is shown in a simplified equivalent form for explanation.

The print head 132 includes the light emitting thyristor 210C whose gate is driven by the scanning circuit 100C. The light emitting thyristor 210C shown in FIG. 16A represents a plurality of light emitting thyristors 210C-1 to 210C-n connected in parallel with one another. A capacitor 210*a* is connected across the anode and cathode of the light emitting thyristor 210C. The capacitor 210*a* is a lumped model of parasitic capacitances that actually exist across the anode and cathode of light emitting thyristors 210. The lumped model is a sum of parasitic capacitance, Cj, of emitting thyristors 210-1 to 210-n of static capacitance.

The parasitic capacitance of each light emitting thyristor is rather small but the resultant capacitance of all the parasitic capacitances Cj is not negligibly small: about 192 times that of a signal light emitting thyristor since 192 light emitting thyristors are connected together.

The light emitting thyristor 210C shown in FIG. 16A is a lumped model of a plurality of light emitting thyristors 210-1 and 210-n. This light emitting thyristor 210C has an anode connected to the data terminal DA and a cathode connected to the ground GND. The capacitor 210*a* is connected between the anode and cathode of the lumped model of the light emitting thyristors 210C.

FIG. 16B illustrates the waveform of the ON/OFF command signal DRVON-N, potential on the node N, potential on the data terminal DA, anode current Ia through the light emitting thyristor 210, and light power Po.

At time t1 in FIG. 16B, the ON/OFF command signal DRVON-N is at the High level, which is then inverted by the CMOS inverter to become the Low level. Thus, the potential at the node N is substantially equal to the supply voltage VDD divided by the resistors 64 and 65, and serves as the anode potential of the light emitting thyristor 210C. As a result, the light emitting thyristor 210C turns off. In other words, the light emitting thyristor can be turned off by setting the potential at the node N slightly lower than the threshold voltage Vf of the light emitting thyristor 210C.

The voltage V3 is determined as follows:

$$V3 = \frac{R65}{R64 + R65} \times VDD$$

where V3 is the voltage at the node N, R65 is the resistance of the resistor 65, and R64 is the resistance of the resistor 64.

At time t2, the ON/OFF command signal DRVON-N goes high and the PMOS transistor 63C turns on, causing the potential at the node N to increase to the High level as depicted at "a." The potential on the data terminal DA goes high as depicted at "b."

As described above, the capacitor 210*a* is connected between the data terminal DA and the ground GND and the capacitance Cj of the capacitor 210*a* is 192 times that of a single light emitting thyristor 210 if 192 light emitting thyristors are used. As a result, neglecting the ON resistance of the NMOS 63, the rise time Tr of the waveform is proportional to the product of the resistance RO of the resistor 66 and the capacitance Cj of the capacitor 210*a* as follows:

$$Tr \propto RO \times Cj$$

As described previously, the capacitance of the capacitor 210*a* is a resultant capacitance of parasitic capacitances of the light emitting thyristors 210C-1 to 210C-n, and has a large value.

The resistor 66 having the resistance RO serves as a current limiting resistor that sets the anode current Ia, and therefore cannot be selected independently and cannot be small. As a result, the time constant of the data driver section 60C will necessarily be long.

It is to be noted that the Low level on the data terminal DA is set above the ground GND. Thus, as depicted at "b" shown in FIG. 16B, the waveform on the data terminal DA is a voltage which is higher than the GND by Von at the end of a rise time Tr, so that the anode-cathode voltage of the light emitting thyristor 210C is equal to Von (ON voltage of the light emitting thyristor 210C). Thus, the light emitting thyristor 210C turns on, the anode current Ia rises as depicted at "c." The anode current Ia rises with a delay time Td1. The anode current Ia causes the light emitting thyristor 210C to emit light so that the light power Po rises as depicted at "d."

Comparing FIG. 16B and FIG. 10B reveals that the data drive section 60C of the first embodiment provides a shorter rise time Tr of the waveform on the data terminal DA. Also, the delay time Td1 for the anode current Ia to rise is shorter.

At time t3, the ON/OFF command signal DRVON rises and the PMOS transistor 63C turns off, so that the waveform at the node N on the drain side falls as depicted at "e." Thus, the waveform on the data terminal DA goes low through the resistor 66 as depicted at "f". The waveform on the data terminal DA falls with a delay time Tf to a voltage higher than the ground GND plus the ON voltage Von of the light emitting thyristor 210C, so that the anode-cathode voltage of the light emitting thyristor 210C is lower than the ON voltage Von. Thus, the light emitting thyristor 210C turns off and the anode current Ia decreases as depicted at "g." Since the anode current Ia falls, the light emitting thyristor 210C no longer emits light so that the waveform of the light power Po falls as depicted at "h."

Referring to FIG. 16B, the Low level of the waveform on the data terminal DA is slightly lower than the ON voltage Von of the light emitting thyristor 210C so that the rise time Tr and fall time Tf are related such that Tr≈Tf. Also, the anode current Ia rises with the delay time Td1 and falls with a delay time Td2. The delay times Td1 and Td2 are related such that Td1≈Td2. Further, the light power Po rises with a delay time Td3 and falls with a delay time Td4. The delay times Td3 and Td4 are related such that Td3≈Td4.

Thus, the effective duration during which the light emitting thyristor emits light can be substantially equal to the difference between time t3 and time t2. This implies that the print head 13C illuminates the charged surface of the photoconductive drum 11 without loosing a significant portion of exposure energy and poor printing result can be avoided.

{Effects of Second Embodiment}

The second embodiment provides the following effects.

(1) The light emitting thyristors 210C-1 to 210C-n are driven by the data driver section 60C that employs the voltage dividing resistors 64 and 65. The potential on the data terminal DA is set equal to the supply voltage VDD divided by the resistors 64 and 65, thereby shortening the time required for the light emitting thyristors to turn on that would otherwise be significantly long due to a large resultant parasitic capacitance across the anode and cathode of the light emitting thyristors. This configuration eliminates loss of exposure energy when the print head 13 illuminates the charged surface of the photoconductive drum 11, and therefore solves the problem of poor printing operation.

(2) The use of the print head 132 of the aforementioned configuration provides the image forming apparatus 1 that is excellent in space utilization efficiency and light output efficiency. The print head 132 is particularly useful for a full color image forming apparatus that uses more than one print heads 132.

{Other Modifications to First and Second Embodiments}

The present invention is not limited to the first and second embodiments and their modifications, and may be further modified in a variety of ways. Such modifications may include the following (1) and (2).

(1) The first and second embodiments have been described with respect to light emitting thyristors 210 and 210C as a light source. The present invention may be applied to a configuration in which thyristors are used as switching elements for controlling the voltage applied to elements (e.g., electroluminescence elements) connected in series with the thyristors. For example, the invention may be applied to apparatus such as printers that employ a print head based on arrays of electroluminescence elements, and display units having rows and/or columns of display elements.

(2) The invention may also be applied to thyristors used as switching elements for driving display elements, for example, arranged in a row or a matrix.

The invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. A driver apparatus for driving a plurality of aligned light emitting thyristors, wherein each light emitting thyristor including a first terminal, a second terminal, and a control terminal that causes the light emitting thyristor to turn on and off, the driver apparatus comprising:

a common terminal, each light emitting thyristor being disposed at one of a first position where the first terminal is connected to the first potential and the second terminal is connected to the common terminal and a second position where the first terminal is connected to the common terminal and the second terminal is connected to the second potential;

a first resistor connected between the first potential and the common terminal;

a second resistor connected between the common terminal and the second potential, wherein the first resistor and the second resistor constitute a voltage divider that divides a difference between the first and the second potential;

a switch connected at one of a third position where the switch is connected between the first potential and the common terminal and a fourth position where the switch is connected between the common terminal and the second potential, the switch being driven by a control signal to close and open.

2. The driver apparatus according to claim 1, wherein the first potential is a supply voltage and the second potential is the ground, wherein the first terminal is an anode, the second terminal is a cathode, and the control terminal is a gate.

3. The driver apparatus according to claim 1, wherein the potential on the common terminal is higher than the first potential minus a voltage across the first terminal and the second terminal when the light emitting thyristor has turned on.

4. The driver apparatus according to claim 1, wherein the potential on the common terminal is lower than the first potential minus a voltage across the first terminal and the second terminal when the light emitting thyristor has turned on.

5. The driver apparatus according to claim 1, wherein the control terminal is a first control terminal, and the driver apparatus further comprises:

a clock driver circuit including a first clock terminal from which a first clock is outputted and a second clock terminal from which a second clock is outputted;

a scanning circuit including;

a plurality of aligned scanning thyristors, each scanning thyristor including a third terminal, a fourth terminal, and a second control terminal that is connected to the first control terminal, wherein an odd-numbered scanning thyristor is disposed at a fifth position where the third terminal of the odd-numbered scanning thyristor is connected to the first clock terminal and the fourth terminal of the odd-numbered scanning thyristor is connected to the second potential, and an even-numbered scanning thyristor is disposed at a sixth position where the third terminal of the even-numbered scanning thyristor is connected to the second clock terminal and the fourth terminal of the even-numbered scanning thyristor is connected to the second potential; and a diode connected between the second control terminal of the odd-numbered scanning thyristor of adjacent scanning thyristors and the second control terminal of the even-numbered scanning thyristor of the adjacent scanning thyristors.

6. A print head incorporating a plurality of light thyristors and the driver apparatus according to claim 5.

7. An image forming apparatus incorporating the print head according to claim 6, wherein the image forming apparatus including:

an image bearing body;

a charging section that charges a surface of the image bearing body; and a developing section;

wherein the print head illuminates the charged surface of the image bearing body to form an electrostatic latent image, and the developing section develops the electrostatic latent image into a visible image.

8. The driver apparatus according to claim 1, wherein the control terminal is a first control terminal, and the driver apparatus further comprises:

a clock driver circuit including a first clock terminal from which a first clock is outputted and a second clock terminal from which a second clock is outputted;

a scanning circuit including;

a plurality of aligned scanning thyristors, each scanning thyristor including a third terminal, a fourth terminal, and a second control terminal that is connected to the first control terminal, wherein an odd-numbered scanning thyristor is disposed at a third position between where the third terminal of the odd-numbered scanning thyristor is connected to the first potential and the fourth terminal of the odd-numbered scanning thyristor is connected to the first clock terminal, and an even-numbered scanning thyristor is disposed at a fourth position where the third terminal of the even-numbered scanning thyristor is connected to the first potential and the fourth terminal of the even-numbered scanning thyristor is connected to the second clock terminal; and a diode connected between the second control terminal of the odd-numbered scanning thyristor of adjacent scanning thyristors and the second control terminal of the even-numbered scanning thyristor of the adjacent scanning thyristors.

9. A print head incorporating a plurality of light thyristors and the driver apparatus according to claim 8.

10. An image forming apparatus incorporating the print head according to claim 9, wherein the image forming apparatus including:

an image bearing body;

a charging section that charges a surface of the image bearing body; and a developing section;

wherein the print head illuminates the charged surface of the image bearing body to form an electrostatic latent image, and the developing section develops the electrostatic latent image into a visible image.

* * * * *